US009478902B2

(12) United States Patent
Komoto et al.

(10) Patent No.: US 9,478,902 B2
(45) Date of Patent: Oct. 25, 2016

(54) CONNECTOR AND CONNECTOR UNIT

(71) Applicant: Japan Aviation Electronics Industry, Ltd., Tokyo (JP)

(72) Inventors: Tetsuya Komoto, Tokyo (JP); Osamu Hashiguchi, Tokyo (JP); Yu Tatebe, Tokyo (JP); Ryuzo Shimeno, Tokyo (JP)

(73) Assignee: JAPAN AVIATION ELECTRONICS INDUSTRY, LTD., Tokyo (JP)

( * ) Notice: Subject to any disclaimer, the term of this patent is extended or adjusted under 35 U.S.C. 154(b) by 0 days.

(21) Appl. No.: 14/219,253

(22) Filed: Mar. 19, 2014

(65) Prior Publication Data

US 2014/0287610 A1 Sep. 25, 2014

(30) Foreign Application Priority Data

Mar. 19, 2013 (JP) ..... 2013-056638

(51) Int. Cl.
*H01R 13/627* (2006.01)
*H01R 12/70* (2011.01)
*H01R 12/71* (2011.01)

(52) U.S. Cl.
CPC ..... *H01R 13/627* (2013.01); *H01R 12/7029* (2013.01); *H01R 12/716* (2013.01)

(58) Field of Classification Search
CPC ..... H01R 12/71; H01R 12/16; H01R 12/17; H01R 12/18; H01R 23/68; H01R 12/7029; H01R 12/716; H01R 13/627; H01R 13/11
USPC ..... 439/350, 660, 11, 135, 940, 626
See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/52 439/353

(Continued)

FOREIGN PATENT DOCUMENTS

JP 2006228612 A 8/2006
JP 2007-287394 A 11/2007

(Continued)

OTHER PUBLICATIONS

Korean Official Action dated Feb. 16, 2015, in connection with KR Application No. 10-2014-0026312.

(Continued)

*Primary Examiner* — Abdullah Riyami
*Assistant Examiner* — Nader Alhawamdeh
(74) *Attorney, Agent, or Firm* — Maier & Maier, PLLC

(57) ABSTRACT

A receptacle used to be mounted on a receptacle-side substrate includes: a frame body; a plurality of cantilevers formed to extend from the frame body and including a substrate separating portion extending in a direction away from the receptacle-side substrate; a contact cover disposed on an opposite side of the receptacle-side substrate with the substrate separating portion of the plurality of cantilevers interposed therebetween, and covering the substrate separating portion of the plurality of cantilevers; and a plurality of conductive patterns formed above the plurality of cantilevers with an insulating layer interposed therebetween. The frame body forms a plug accommodating space for accommodating a plug. The plug accommodating space is formed so as to surround the substrate separating portion of the plurality of cantilevers.

8 Claims, 21 Drawing Sheets

(56) References Cited

U.S. PATENT DOCUMENTS 6,116,949 A * 9/2000 Costello ..... H01R 13/6485 439/509
6,855,004 B2 * 2/2005 Soh ..... H01L 23/60 439/41
6,955,546 B1 * 10/2005 Huang ..... H01R 13/5213 439/135
7,074,085 B2 * 7/2006 Chen ..... H01R 23/6873 439/108
7,232,317 B2 * 6/2007 Ookura ..... H01R 13/506 439/660
7,367,816 B2 * 5/2008 Liu ..... H01R 13/26 439/74
7,748,994 B1 * 7/2010 Peng ..... H01R 13/6315 439/660
7,922,499 B2 * 4/2011 Liao ..... H01R 12/714 439/660
8,272,881 B2 * 9/2012 Miyazaki ..... H01R 13/20 439/345
8,292,635 B2 * 10/2012 Little ..... H01R 12/7029 439/570
8,992,233 B2 * 3/2015 Miyazaki ..... H01R 12/707 439/74
9,112,311 B2 * 8/2015 Asai ..... H01R 13/658
2004/0018756 A1 * 1/2004 Pan ..... H01R 13/6271 439/74
2010/0130068 A1 * 5/2010 Peng ..... H01R 13/2457 439/660
2010/0190383 A1 * 7/2010 Yamada ..... H01R 12/716 439/680
2010/0267287 A1 10/2010 Ishikawa et al.
2011/0165797 A1 * 7/2011 Takeuchi ..... H01R 12/716 439/660
2011/0201226 A1 8/2011 Suzuki et al.
2011/0250800 A1 * 10/2011 Guo ..... H01R 12/716 439/660
2012/0100743 A1 * 4/2012 Ohsaka ..... H01R 12/775 439/345
2013/0012074 A1 * 1/2013 Mashiyama ..... H01R 12/73 439/660
2013/0023162 A1 * 1/2013 Harlan ..... H01R 12/73 439/660
2014/0227910 A1 * 8/2014 Tanaka ..... H01R 12/7052 439/626

FOREIGN PATENT DOCUMENTS

KR 10-2010-0116130 A 10/2010
KR 10-2011-0084925 A 7/2011
WO WO 2012033913 A2 * 3/2012 ..... H01R 12/716
WO WO 2013031112 A1 * 3/2013 ..... H01R 12/7052

OTHER PUBLICATIONS

Korean Office Action dated Aug. 17, 2015, in connection with corresponding KR Application No. 10-2014-0026312 (8 pgs.).
Korean Office Action dated Feb. 16, 2016, in connection with corresponding KR Application No. 10-2014-0026312 (7 pgs., including partial English translation).
Chinese Office Action dated May 11, 2016, in connection with corresponding CN Application No. 201410081988.9 (12 pgs., including English translation).

* cited by examiner

RELATED ART

PRIOR ART

PRIOR ART

CONNECTOR AND CONNECTOR UNIT

INCORPORATION BY REFERENCE

This application is based upon and claims the benefit of priority from Japanese patent application No. 2013-056638, filed on Mar. 19, 2013, the disclosure of which is incorporated herein in its entirety by reference.

BACKGROUND OF THE INVENTION

1. Field of the Invention

The present invention relates to a connector and a connector unit.

2. Description of Related Art

As a technique of this type, Japanese Unexamined Patent Application Publication No. 2006-228612 discloses a connector 101 having a structure in which an insulating layer is formed on one surface of a base material 100, which is a metallic plate, and metal plating is formed on the insulating layer to thereby form a conductor portion, as shown in FIG. 18 of the present application. This connector 101 is mounted on a printed wiring board 102 by mounting a bottom portion 100*a* of the base material 100 on the printed wiring board 102.

SUMMARY OF THE INVENTION

As shown in FIG. 19, the present inventors have developed a receptacle connector 3P which is used to be mounted on a receptacle-side substrate 2P and has a structure in which an insulating layer is formed on a metallic plate and a plurality of conductive patterns are formed on the insulating layer, thereby allowing each conductive pattern to function as a contact. The receptacle connector 3P mates with a plug connector mounted on a plug-side substrate, thereby connecting the receptacle-side substrate 2P to the plug-side substrate.

As shown in FIGS. 19 to 21, the receptacle connector 3P includes a plurality of cantilevers 6P arranged in a comb-like manner, and an outer frame body 7P surrounding the plurality of cantilevers 6P. As shown in FIG. 20, the plurality of cantilevers 6P are arranged in two rows in parallel with a connector mounting surface 2*a*P of the receptacle-side substrate 2P.

The terms "pitch direction", "pitch orthogonal direction", and "height direction" used herein are defined with reference to FIG. 20. The term "pitch direction" refers to a direction in which a number of the cantilevers 6P are arranged. In the "pitch direction", a direction approaching the center of the receptacle connector 3P is defined as "pitch center direction" and a direction away from the center of the receptacle connector 3P is defined as "pitch anti-center direction". The term "pitch orthogonal direction" refers to a direction which is parallel to the connector mounting surface 2*a*P of the receptacle-side substrate 2P and which is orthogonal to the pitch direction. In the "pitch orthogonal direction", a direction approaching the center of the receptacle connector 3P is defined as "pitch orthogonal center direction" and a direction away from the center of the receptacle connector 3P is defined as "pitch orthogonal anti-center direction". The term "height direction" refers to a direction which is orthogonal to the connector mounting surface 2*a*P of the receptacle-side substrate 2P. In the "height direction", a direction approaching the connector mounting surface 2*a*P of the receptacle-side substrate 2P is defined as "substrate approaching direction" and a direction away from the connector mounting surface 2*a*P of the receptacle-side substrate 2P is defined as "substrate separating direction". The pitch direction, the pitch orthogonal direction, and the height direction are orthogonal to each other.

As shown in FIGS. 19 to 21, the outer frame body 7P includes a top plate 8P and a pair of side plates 9P.

As shown in FIG. 20, the top plate 8P is disposed on an opposite side of the receptacle-side substrate 2P with the plurality of cantilevers 6P interposed therebetween, and is substantially parallel to the receptacle-side substrate 2P. The top plate 8P includes an insertion opening unit 10P into which the plug connector is inserted. The insertion opening unit 10P is formed of a pair of insertion openings 11P. In other words, the pair of insertion openings 11P is formed in the top plate 8P. The pair of insertion openings 11P is disposed side by side in the pitch orthogonal direction. Each insertion opening 11P is formed to be elongated in the pitch direction. The top plate 8P includes a top plate central portion 8*a*P. The top plate central portion 8*a*P is disposed between the pair of insertion openings 11P in the pitch orthogonal direction. The pair of insertion openings 11P is partitioned by the top plate central portion 8*a*P.

As shown in FIG. 20, the pair of side plates 9P is disposed so as to sandwich the plurality of cantilevers 6P in the pitch orthogonal direction. The pair of side plates 9P is connected to an end in the pitch orthogonal direction of the top plate 8P, and is formed to extend in the substrate approaching direction.

As shown in FIG. 21, each cantilever 6P includes a linear portion 6*a*P which is connected to a lower end 9*a*P of the corresponding side plate 9P of the outer frame body 7P and extends in the pitch orthogonal center direction; and a curved portion 6*b*P which is connected to the linear portion 6*a*P and is curved to be directed toward the substrate separating direction, the pitch orthogonal anti-center direction, and the substrate approaching direction in the stated order. An apex 6*c*P, which is a portion of each cantilever 6P that is farthest from the receptacle-side substrate 2P, is covered by the top plate central portion 8*a*P of the top plate 8P.

The receptacle connector 3P having the structure described above has a plurality of conductive patterns *c*P formed thereon as shown in FIG. 19. Each conductive pattern *c*P functions as a contact.

As shown in FIGS. 20 and 21, the conductive patterns *c*P are formed over the cantilevers 6P, the side plates 9P, and the top plate 8P.

The plug connector mating with the receptacle connector 3P having the structure described above includes, for example, a pair of inserted portions to be respectively inserted into the pair of insertion openings 11P of the top plate 8P of the receptacle connector 3P; and a connecting portion which is parallel to the plug-side substrate and connects the pair of inserted portions. In the structure of the receptacle connector 3P described above, a rib or the like cannot be formed between the connecting portion and the pair of inserted portions of the plug connector, which inhibits an improvement in the strength of the plug connector.

It is an object of the present invention to provide a technique for improving the strength of a counterpart connector.

A first exemplary aspect of the present invention is a connector used to be mounted on a substrate, the connector including: a metal frame body; a plurality of metal cantilevers formed to extend from the metal frame body and including a substrate separating portion extending in a direction away from the substrate; a cover body disposed on an opposite side of the substrate with the substrate separating portion of the plurality of metal cantilevers interposed therebetween, and covering the substrate separating portion of the plurality of metal cantilevers; and a plurality of conductive patterns formed above the plurality of metal cantilevers with an insulating layer interposed therebetween. The metal frame body forms a counterpart connector accommodating space for accommodating a counterpart connector. The counterpart connector accommodating space is formed so as to surround the substrate separating portion of the plurality of metal cantilevers.

The connector further includes a cover body fixing portion for fixing the cover body to the substrate.

The cover body fixing portion includes a leg portion extending from the cover body toward the substrate, and a fixed portion to be fixed to the substrate.

The connector further includes a temporary holding portion for temporarily holding the cover body on the metal frame body.

The cover body fixing portion is disposed between the cover body and the temporary holding portion.

A second exemplary aspect of the present invention is a connector unit including the connector and the counterpart connector. The counterpart connector includes a plurality of contacts and an insulator that holds the plurality of contacts. The insulator includes an accommodated portion to be accommodated in the counterpart connector accommodating space of the connector.

The counterpart connector includes a positioning contact portion to be brought into contact with the connector in a pitch direction to perform positioning of the plurality of conductive patterns of the connector and the plurality of contacts of the counterpart connector in the pitch direction.

The positioning contact portion is made of metal.

The connector further includes a locking mechanism that hooks on to the counterpart connector to prevent the counterpart connector mating with the connector from being disengaged from the connector.

According to the present invention, the strength of the counterpart connector can be easily secured.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS (Connector Unit 1)

Figure 1:
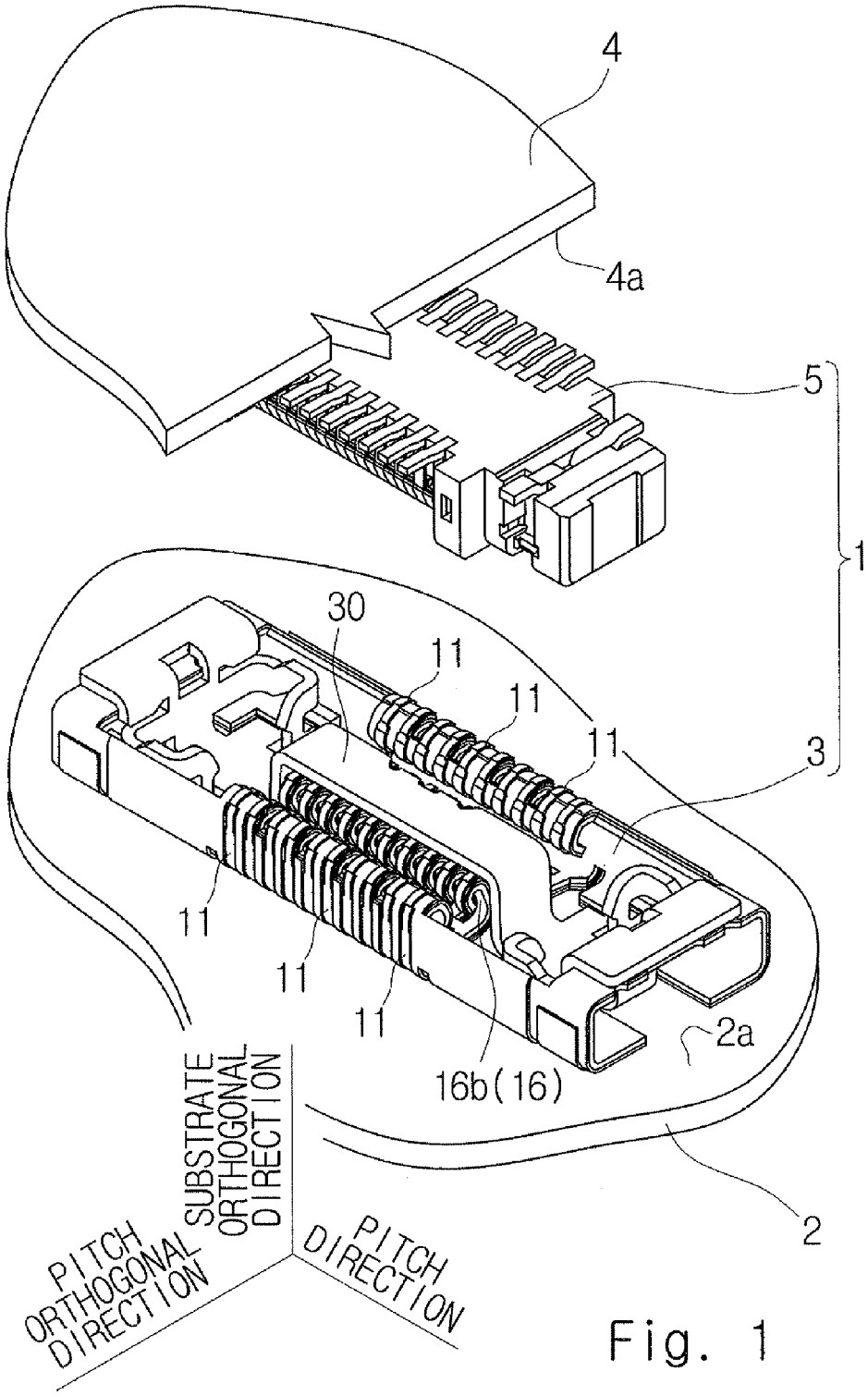
FIG. 1 is a perspective view showing a state before mating of a connector unit.
Figure 2:
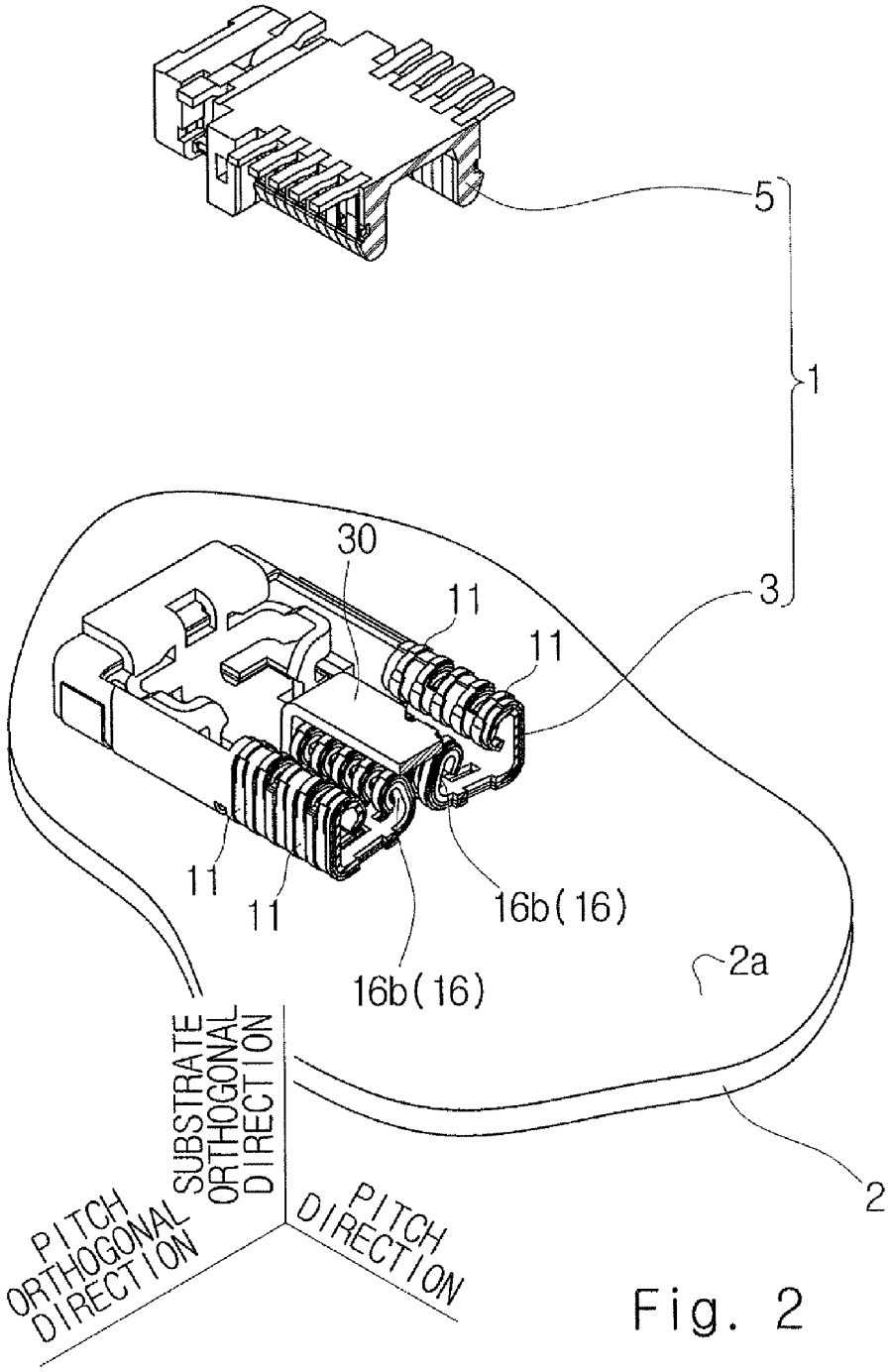
FIG. 2 is a partially cutaway perspective view showing a state before mating of the connector unit.
Figure 3:
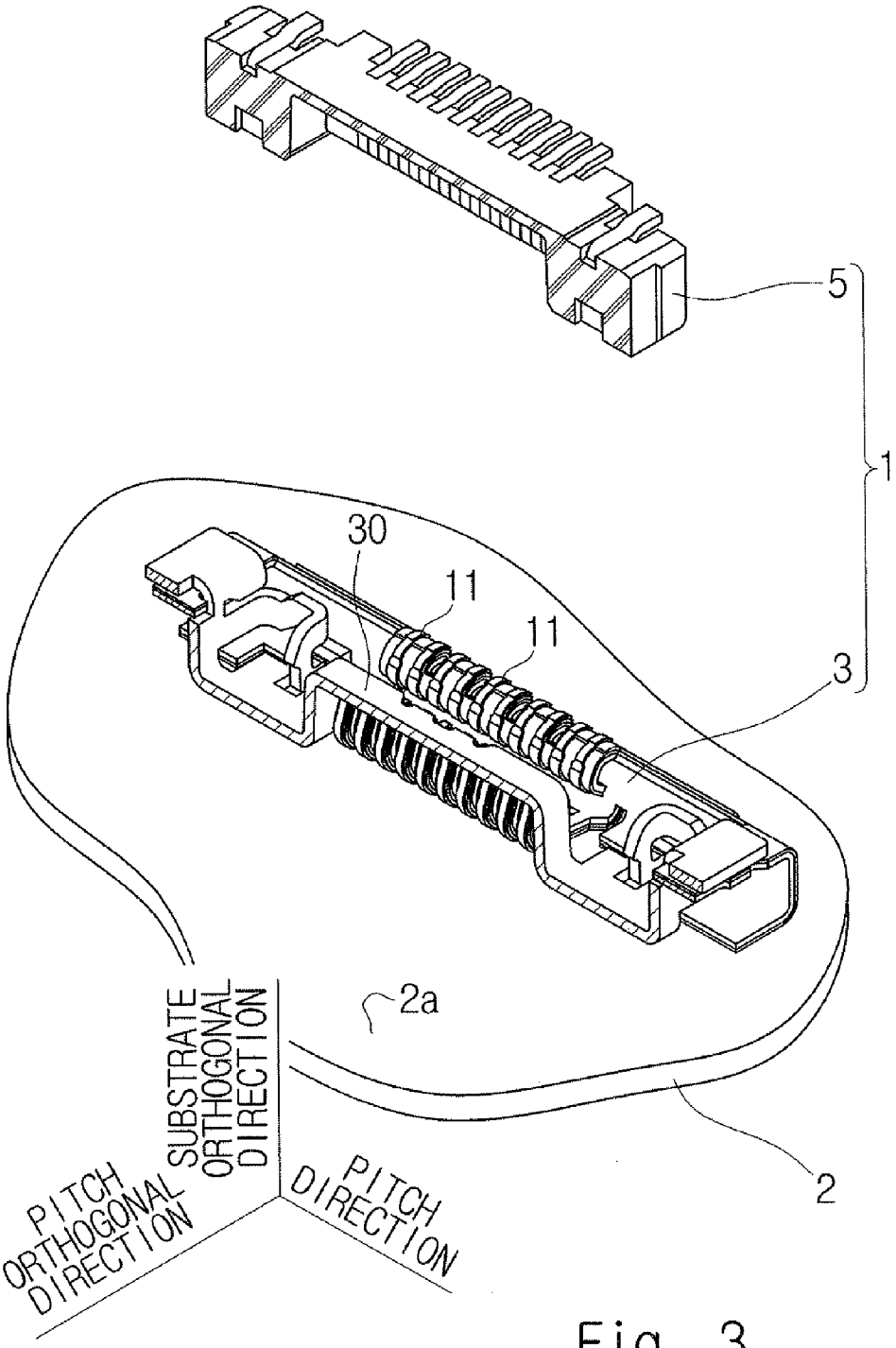
FIG. 3 is a partially cutaway perspective view showing a state before mating of the connector unit.

As shown in FIGS. 1 to 3, a connector unit 1 includes a receptacle 3 (connector) which is used to be mounted on a connector mounting surface 2*a* of a receptacle-side substrate 2, and a plug 5 (counterpart connector) which is used to be mounted on a connector mounting surface 4*a* of a plug-side substrate 4. The connector unit 1 is used to electrically connect the receptacle-side substrate 2 to the plug-side substrate 4. That is, mating of the receptacle 3 with the plug 5 allows the receptacle-side substrate 2 and the plug-side substrate 4 to be electrically connected to each other.

(Receptacle 3)

Figure 4:
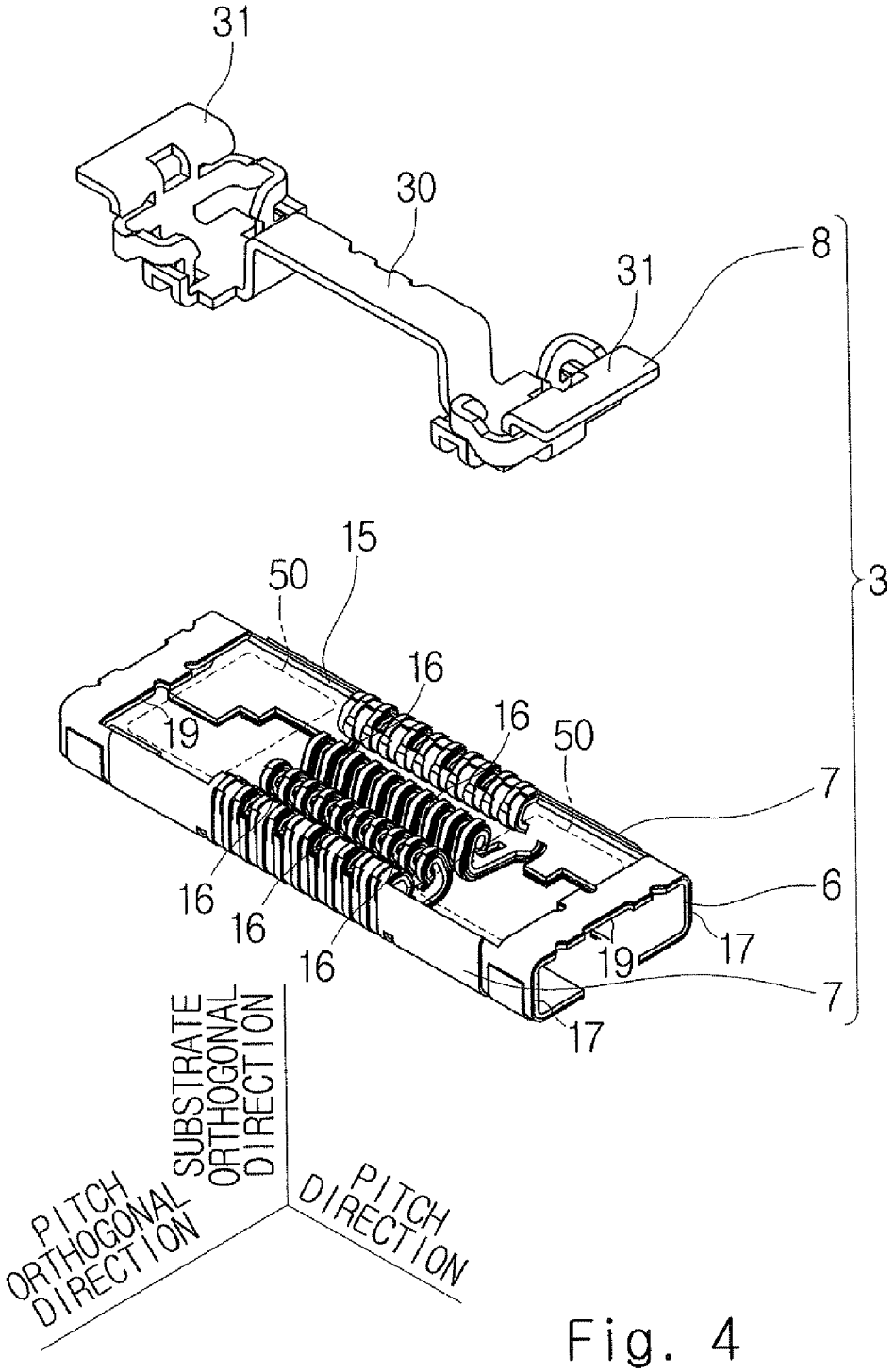
FIG. 4 is an exploded perspective view of a receptacle.

As shown in FIG. 4, the receptacle 3 includes a receptacle body 6, two insulating sheets 7, and an assist fitting 8.

(Receptacle 3: Receptacle Body 6)

Figure 5:
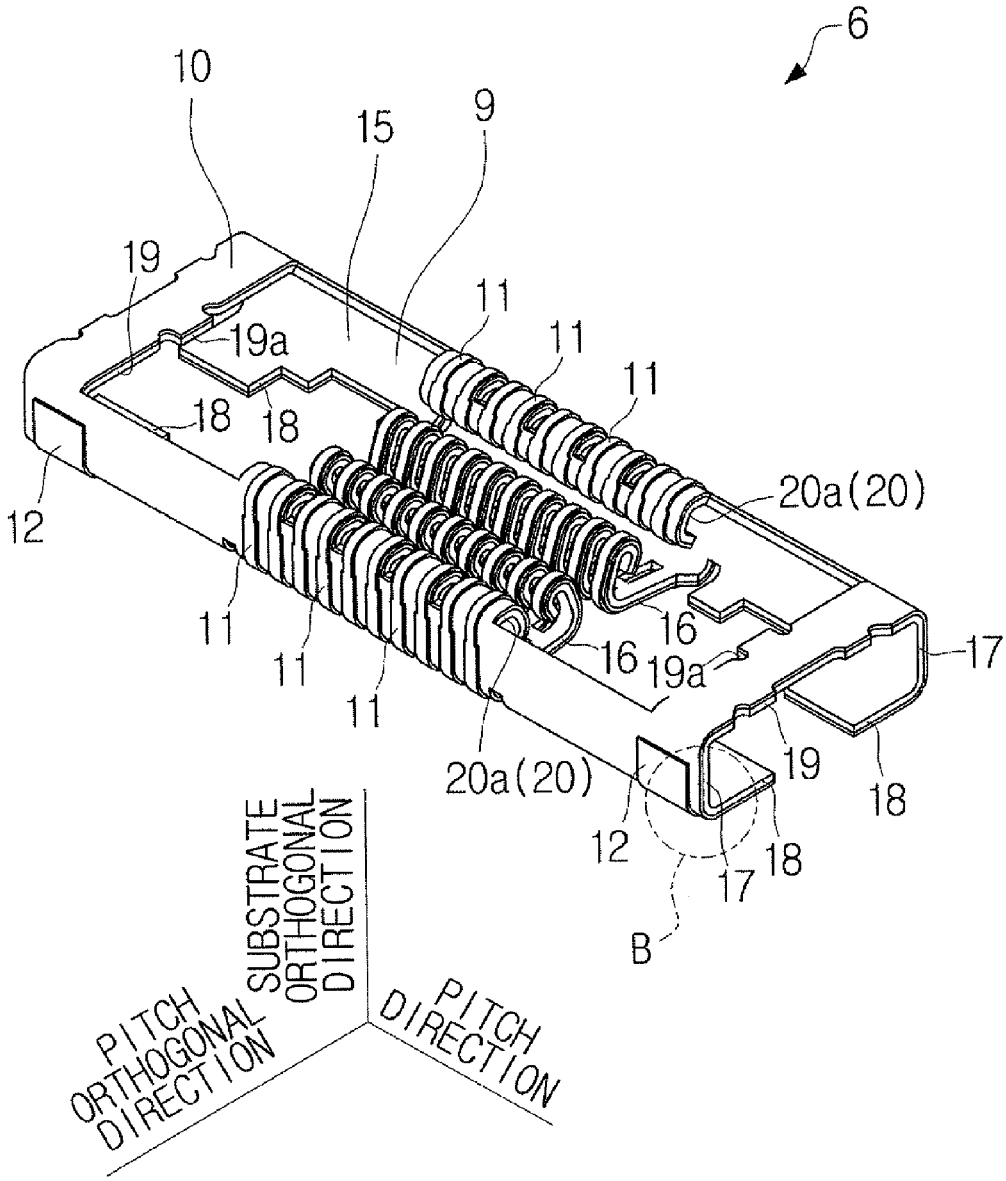
FIG. 5 is a perspective view of a receptacle body.
Figure 6:
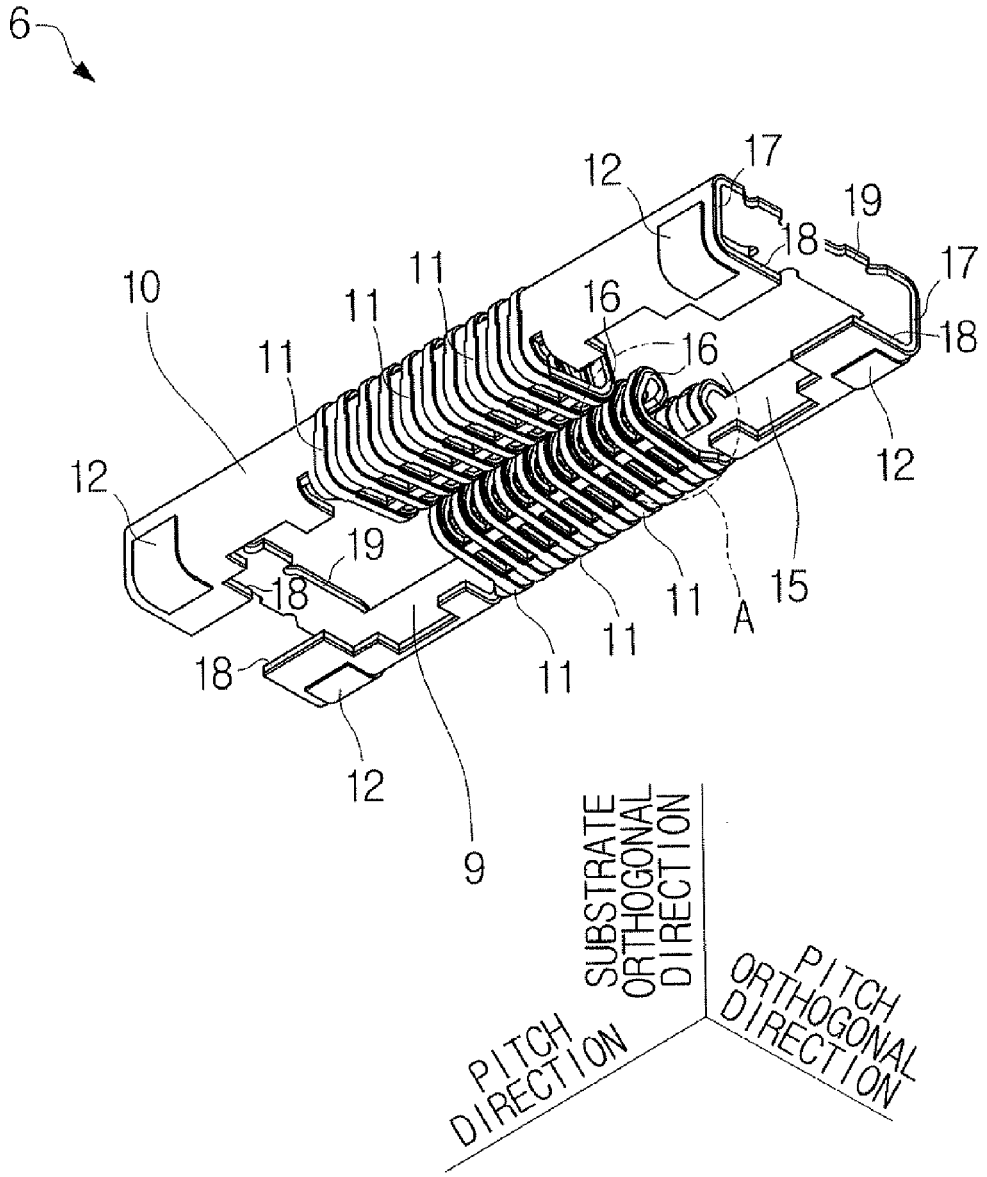
FIG. 6 is a perspective view of the receptacle body viewed from another angle.

As shown in FIGS. 5 and 6, the receptacle body 6 includes a metallic plate 9, an insulating layer 10, a plurality of conductive patterns 11, and four hold-down patterns 12.

As shown in FIG. 1, the plurality of conductive patterns 11 are disposed in two rows. The plurality of conductive patterns 11 belonging to each row are disposed at regular intervals in a direction parallel to the connector mounting surface 2*a* of the receptacle-side substrate 2.

The terms "pitch direction", "pitch orthogonal direction", and "substrate orthogonal direction" used herein are defined below. The term "pitch direction" refers to a direction which is parallel to the connector mounting surface 2*a* of the receptacle-side substrate 2 and in which a number of conductive patterns 11 are arranged. In the "pitch direction", a direction approaching the center of the receptacle 3 is defined as "pitch center direction" and a direction away from the center of the receptacle 3 is defined as "pitch anti-center direction". The term "pitch orthogonal direction" is a direction which is parallel to the connector mounting surface 2*a* of the receptacle-side substrate 2 and which is orthogonal to the pitch direction. In the "pitch orthogonal direction", a direction approaching the center of the receptacle 3 is defined as "pitch orthogonal center direction" and a direction away from the center of the receptacle 3 is defined as "pitch orthogonal anti-center direction". The term "substrate orthogonal direction" refers to a direction which is orthogonal to the connector mounting surface 2*a* of the receptacle-side substrate 2. In the "substrate orthogonal direction", a direction approaching the connector mounting surface 2*a* of the receptacle-side substrate 2 is defined as "substrate approaching direction" and a direction away from the connector mounting surface 2*a* of the receptacle-side substrate 2 is defined as "substrate separating direction". The pitch direction, the pitch orthogonal direction, and the substrate orthogonal direction are orthogonal to each other. The terms "pitch direction", "pitch orthogonal direction", and "substrate orthogonal direction", which are defined as described above with reference to FIG. 1, are also used for explanation of the plug 5. Note that also in the explanation of the plug 5, the terms "substrate approaching direction" and "substrate separating direction" are defined based not on the connector mounting surface 4*a* of the plug-side substrate 4, but on the connector mounting surface 2*a* of the receptacle-side substrate 2.

As shown in FIGS. 5 and 6, the metallic plate 9 includes a frame body 15 (metal frame body) and a plurality of cantilevers 16.

The frame body 15 includes a pair of side plates 17, four hold-down portions 18, a pair of top plates 19, and a pair of guide plates 20.

The pair of side plates 17 is disposed so as to sandwich the plurality of cantilevers 16 in the pitch orthogonal direction. Each side plate 17 is elongated in the pitch direction. The thickness direction of each side plate 17 coincides with the pitch orthogonal direction.

The four hold-down portions 18 are disposed between the pair of side plates 17. Two of the hold-down portions 18 extend in the pitch orthogonal center direction from both of the ends in the pitch direction of one of the side plates 17. Similarly, the other two of the hold-down portions 18 extend in the pitch orthogonal center direction from both of the ends in the pitch direction of the other side plate 17. The thickness direction of each of the hold-down portions 18 coincides with the substrate orthogonal direction.

The pair of top plates 19 is disposed between the pair of side plates 17. One of the top plates 19 extends in the pitch orthogonal direction so as to connect the ends in the substrate separating direction of the pair of side plates 17 at one end thereof in the pitch direction. At the center in the pitch orthogonal direction of one of the top plates 19, a claw portion 19*a* projecting in the pitch center direction is formed. Similarly, the other top plate 19 also extends in the pitch orthogonal direction so as to connect the ends in the substrate separating direction of the pair of side plates 17 at the other end thereof in the pitch direction. At the center in the pitch orthogonal direction of the other top plate 19, the claw portion 19*a* projecting in the pitch center direction is formed. The thickness direction of the pair of top plates 19 coincides with the substrate orthogonal direction.

Figure 7:
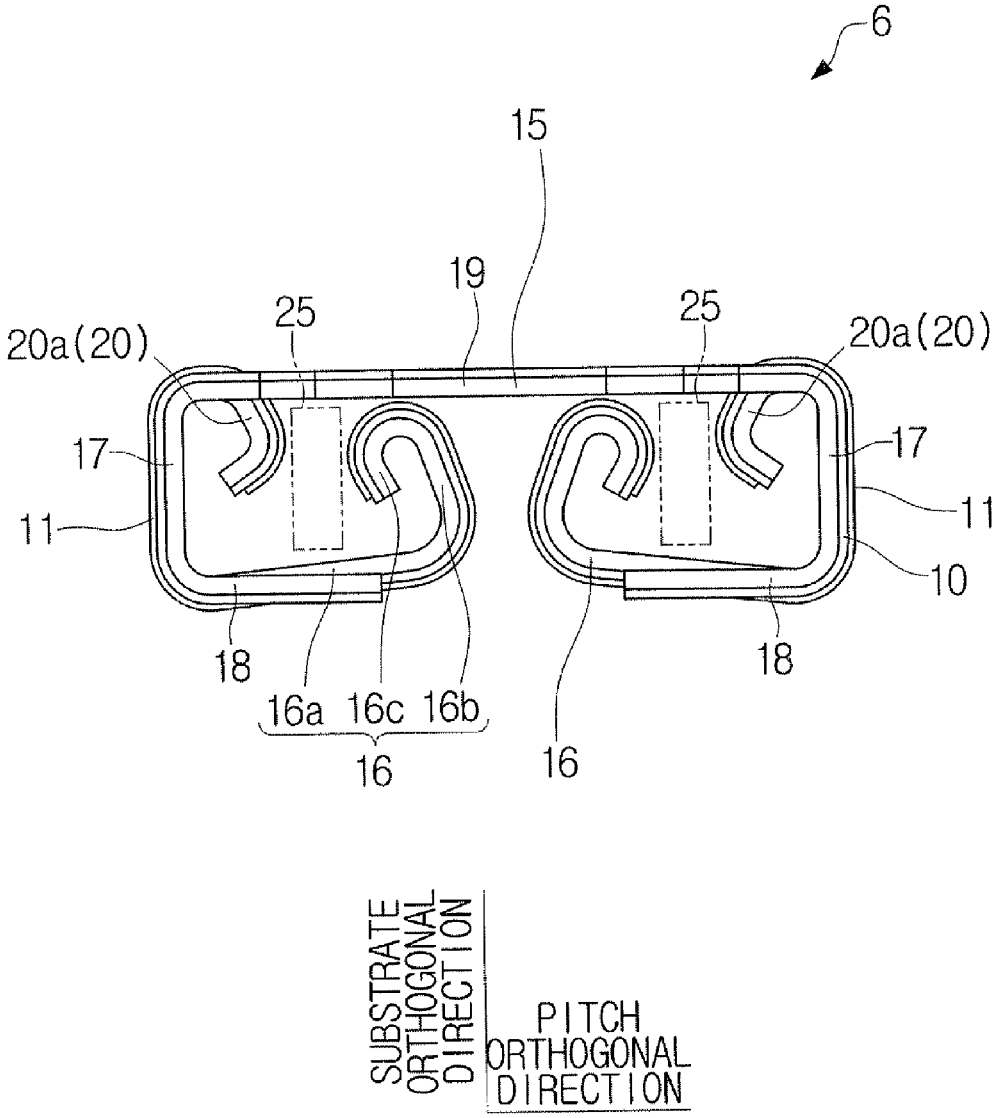
FIG. 7 is a front view of the receptacle body.

The pair of guide plates 20 is disposed between the pair of side plates 17. The pair of guide plates 20 is disposed between the pair of top plates 19. Each guide plate 20 is elongated in the pitch direction. One of the guide plates 20 extends in the substrate approaching direction from an end in the substrate separating direction of one of the side plates 17. As shown in FIG. 7, when the receptacle body 6 is viewed along the pitch direction, one of the guide plates 20 is curved in a convex shape toward the pitch orthogonal center direction. One of the guide plates 20 has a pair of end faces 20*a* which are orthogonal to the pitch direction. Similarly, the other guide plate 20 extends in the substrate approaching direction from an end in the substrate separating direction of the other side plate 17. When the receptacle body 6 is viewed along the pitch direction, the other guide plate 20 is curved in a convex shape toward the pitch orthogonal center direction. The other guide plate 20 has a pair of end faces 20*a* which are orthogonal to the pitch direction.

Figure 8:
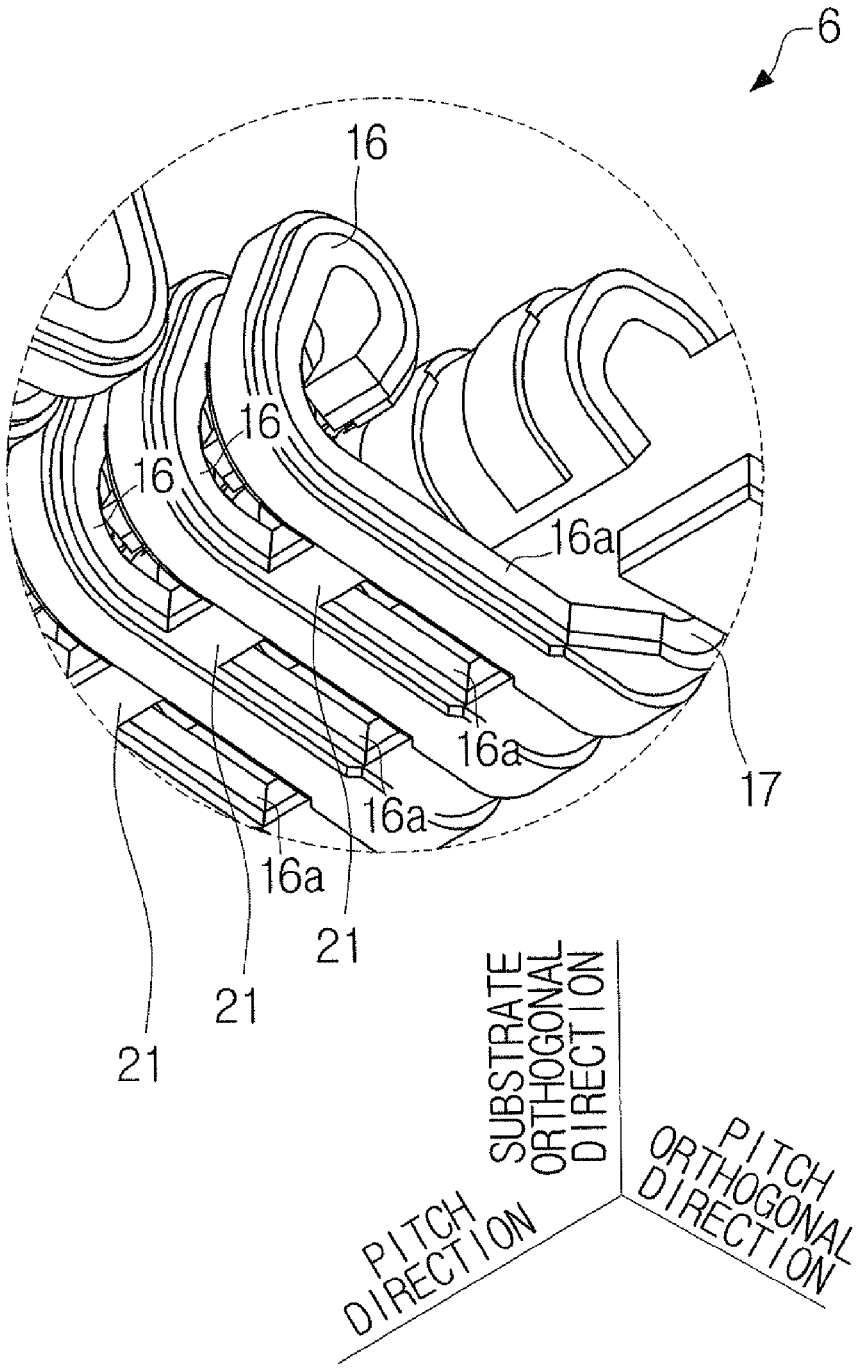
FIG. 8 is an enlarged view of a portion "A" shown in FIG. 6.

As shown in FIG. 5, the plurality of cantilevers 16 are disposed between the pair of side plates 17. The plurality of cantilevers 16 are disposed in two rows along the pitch direction. The plurality of cantilevers 16 belonging to each row extend in the pitch orthogonal center direction from an end in the substrate approaching direction of each side plate 17. As shown in FIG. 7, each cantilever 16 includes a horizontal portion 16*a*, a substrate separating portion 16*b*, and a substrate approaching portion 16*c*. The horizontal portion 16*a* extends in the pitch orthogonal center direction from an end in the substrate approaching direction of the corresponding side plate 17 while being slightly inclined in the substrate separating direction. The substrate separating portion 16*b* extends in the substrate separating direction from an end in the pitch orthogonal center direction of the horizontal portion 16*a*. The substrate separating portion 16*b* extends in the substrate separating direction from an end in the pitch orthogonal center direction of the horizontal portion 16*a* while being slightly inclined in the pitch orthogonal anti-center direction. The substrate approaching portion 16*c* is disposed on the pitch orthogonal anti-center direction side of the substrate separating portion 16*b*. The substrate approaching portion 16*c* extends in the substrate approaching direction from an end in the substrate separating direction of the substrate separating portion 16*b*. The substrate approaching portion 16*c* is curved in a convex shape toward the pitch orthogonal anti-center direction. As shown in FIG. 8, two cantilevers 16 that are adjacent to each other in the pitch direction in each row are connected to each other by a beam connecting portion 21. In other words, the frame body 15 further includes a plurality of the beam connecting portions 21. Each beam connecting portion 21 connects the horizontal portions 16*a* of two cantilevers 16 that are adjacent to each other in the pitch direction in each row.

As shown in FIG. 7, the substrate approaching portion 16*c* of each of the plurality of cantilevers 16 belonging to each row is opposed to the corresponding guide plate 20 in the pitch orthogonal direction. A first plug accommodating space 25 is formed between the corresponding guide plate 20 and the substrate approaching portion 16*c* of each of the plurality of cantilevers 16 belonging to each row. Accordingly, two first plug accommodating spaces 25 are formed in the receptacle body 6. Each of the first plug accommodating spaces 25 is elongated in the pitch direction in the same manner as the guide plates 20 (also see FIG. 12).

Figure 9:
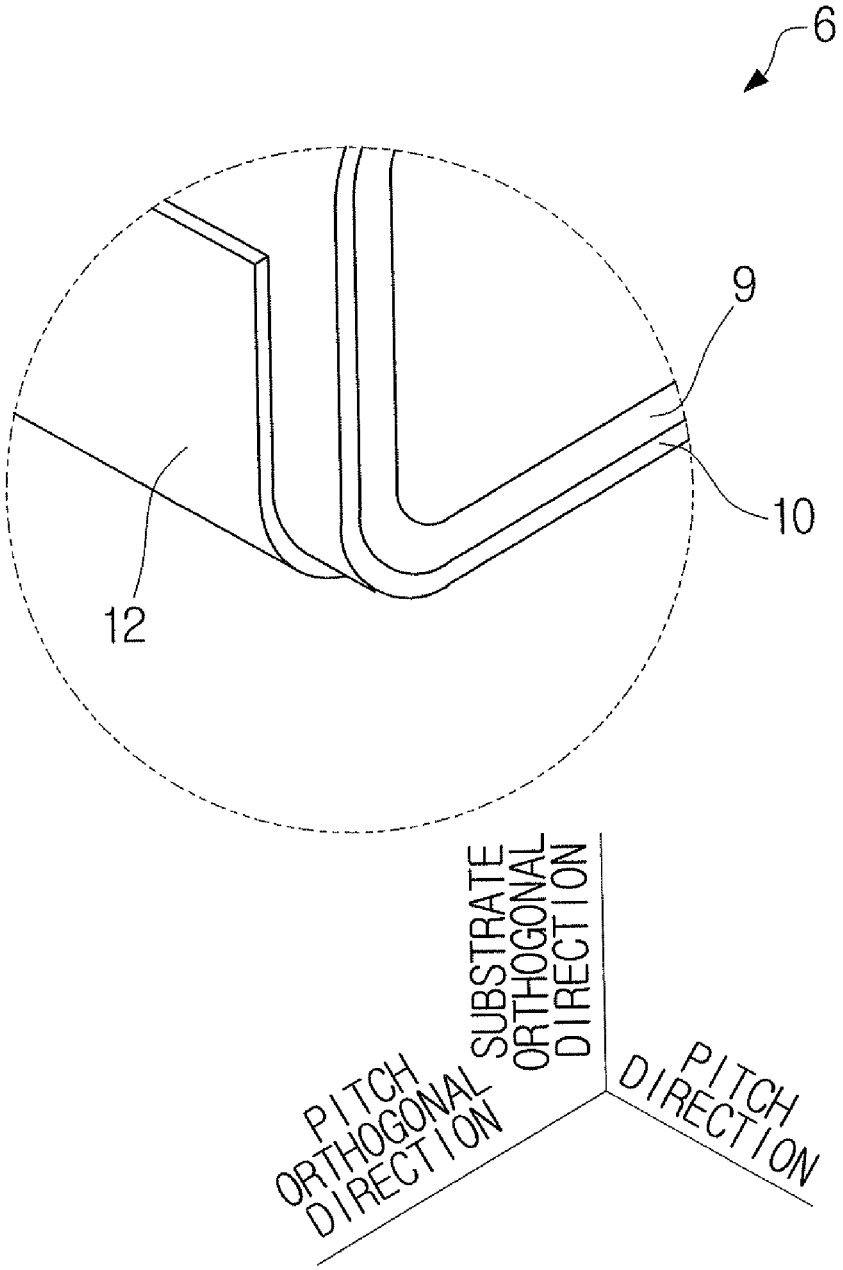
FIG. 9 is an enlarged view of a portion "B" shown in FIG. 5.

As shown in FIG. 9, the insulating layer 10 is formed over the entire outer surface of the metallic plate 9. The insulating layer 10 is formed of, for example, polyimide or aramid. The insulating layer 10 may be formed as an oxide film of the metallic plate 9.

As shown in FIG. 7, the plurality of conductive patterns 11 are formed above the plurality of cantilevers 16 with the insulating layer 10 interposed therebetween. The conductive patterns 11 are each formed in an elongated shape over the cantilevers 16, the side plates 17, and the guide plates 20. Each of the plurality of conductive patterns 11 functions as a so-called contact.

As shown in FIG. 6, each hold-down pattern 12 is formed above the corresponding hold-down portion 18 with the insulating layer 10 interposed therebetween.

(Receptacle 3: Insulating Sheets 7)

As shown in FIG. 4, the two insulating sheets 7 are attached to the receptacle body 6. Each insulating sheet 7 is attached to the outer surface of the corresponding side plate 17 of the frame body 15 of the receptacle body 6 shown in FIG. 5 with the insulating layer 10 interposed therebetween.

(Receptacle 3: Assist Fitting 8)

As shown in FIGS. 10 to 13, the assist fitting 8 includes a contact cover 30 (cover body) and a pair of functional portions 31.

The contact cover 30 is disposed between the pair of functional portions 31. The contact cover 30 extends in an elongated shape in the pitch direction. The thickness direction of the contact cover 30 coincides with the substrate orthogonal direction.

Since the pair of functional portions 31 has the same shape, only one of the functional portions 31 will be described below and the description of the other functional portion 31 will be omitted.

The functional portion 31 includes a contact cover fixing portion 32 (cover body fixing portion), a temporary holding portion 33, and a pair of locking mechanisms E.

The contact cover fixing portion 32 is a portion for fixing the contact cover 30 to the connector mounting surface 2*a* of the receptacle-side substrate 2. The contact cover fixing portion 32 includes a leg portion 34 and a fixed portion 35. The leg portion 34 extends from an end in the pitch direction of the contact cover 30 toward the connector mounting surface 2*a* of the receptacle-side substrate 2. The thickness direction of the leg portion 34 coincides with the pitch direction. The fixed portion 35 is a portion to be fixed to the connector mounting surface 2*a* of the receptacle-side substrate 2. The fixed portion 35 extends in the pitch anti-center direction from an end in the substrate approaching direction of the leg portion 34. The thickness direction of the fixed portion 35 coincides with the substrate orthogonal direction.

Figure 11:
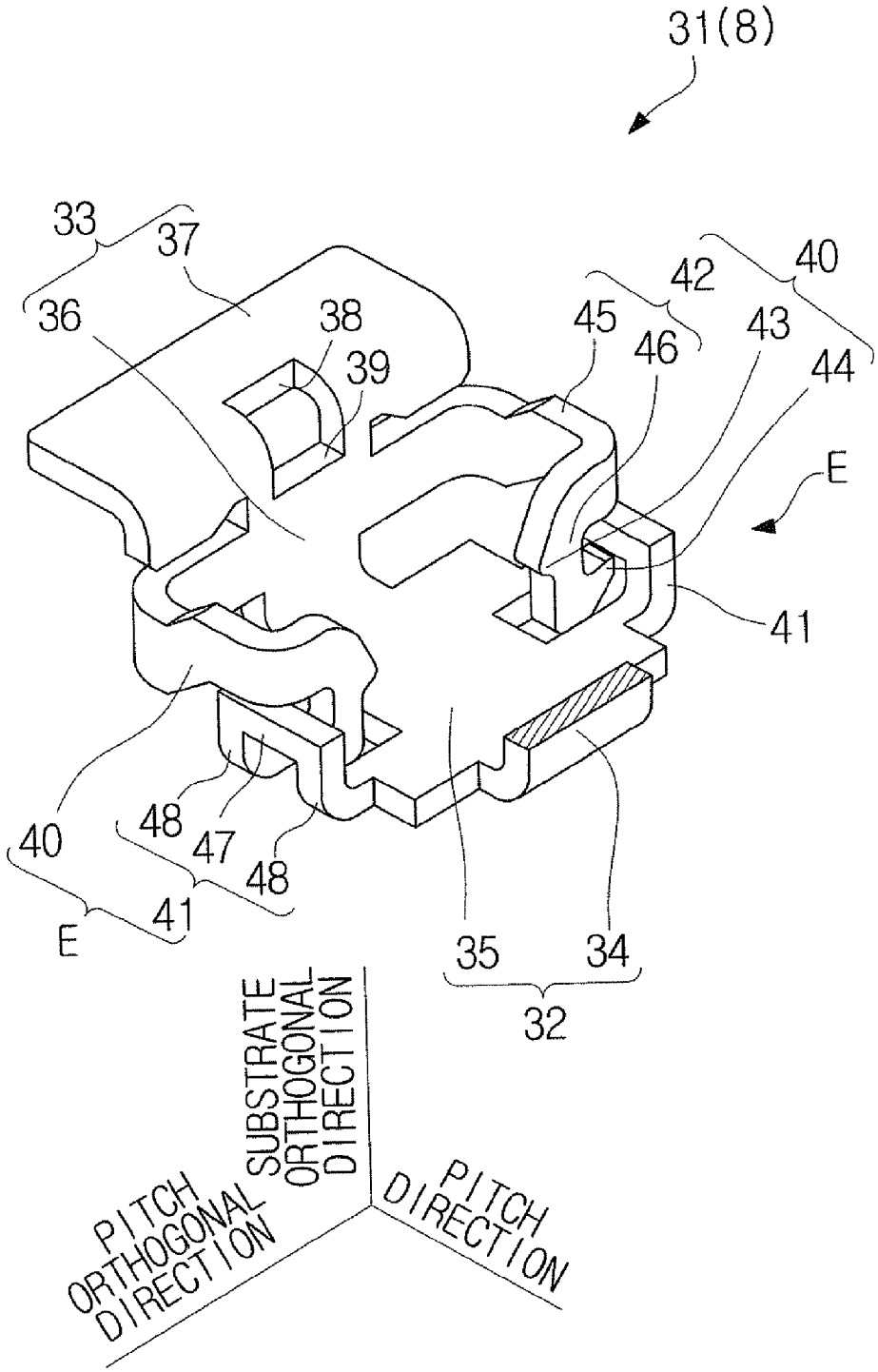
FIG. 11 is a perspective view of a functional portion.

The temporary holding portion 33 is a portion for temporarily holding the contact cover 30 on the frame body 15 of the receptacle body 6. As shown in FIG. 11, the temporary holding portion 33 includes a leg portion 36 and a shoulder portion 37. The leg portion 36 extends in the substrate separating direction from an end in the pitch anti-center direction of the fixed portion 35 of the contact cover fixing portion 32. The thickness direction of the leg portion 36 coincides with the pitch direction. The shoulder portion 37 extends in the pitch anti-center direction from an end in the substrate separating direction of the leg portion 36. The thickness direction of the shoulder portion 37 coincides with the substrate orthogonal direction. The temporary holding portion 33 has a claw accommodating hole 38 formed therein. The claw accommodating hole 38 is formed over the leg portion 36 and the shoulder portion 37. When the claw accommodating hole 38 is formed in the temporary holding portion 33, a hook surface 39 is formed in the leg portion 36. The hook surface 39 is a surface that faces in the substrate separating direction.

The locking mechanisms E include a locking piece 40 and a displacement regulating portion 41.

The locking piece 40 is a cantilever. The locking piece 40 includes a locking piece body 42, a locking claw 43, and a displacement regulating claw 44. The locking piece body 42 includes an elastic portion 45 and a claw holding portion 46. The elastic portion 45 is a portion that enables elastic displacement of the claw holding portion 46. The elastic portion 45 extends from the leg portion 36 of the temporary holding portion 33 in the pitch orthogonal anti-center direction, the pitch center direction, and the pitch orthogonal center direction in the stated order. The claw holding portion 46 is a portion for holding the locking claw 43 and the displacement regulating claw 44. The claw holding portion 46 extends from the distal end of the elastic portion 45 in the substrate approaching direction. The locking claw 43 is formed so as to project in the pitch orthogonal center direction from the center in the substrate orthogonal direction of the claw holding portion 46. The displacement regulating claw 44 is formed so as to project in the pitch orthogonal anti-center direction from an end in the substrate approaching direction of the claw holding portion 46. The presence of the locking piece 40 enables elastic displacement of the locking claw 43 in the pitch orthogonal direction.

The displacement regulating portion 41 includes a displacement regulating beam 47 and a pair of leg portions 48. The displacement regulating beam 47 is disposed on the pitch orthogonal anti-center direction side of the claw holding portion 46. The displacement regulating beam 47 is opposed to the claw holding portion 46 in the pitch orthogonal direction. The displacement regulating beam 47 is disposed on the substrate separating direction side of the displacement regulating claw 44. The displacement regulating beam 47 is opposed to the displacement regulating claw 44 in the substrate orthogonal direction. The pair of leg portions 48 is a portion for supporting the displacement regulating beam 47 on the fixed portion 35 of the contact cover fixing portion 32. The presence of the displacement regulating portion 41 enables regulation of an excessive displacement of the locking claw 43 in the substrate separating direction. Further, the presence of the displacement regulating portion 41 enables regulation of an excessive displacement of the locking claw 43 in the pitch orthogonal anti-center direction.

To mount the assist fitting 8 on the receptacle body 6 in the structure described above, the assist fitting 8 is fitted into the frame body 15 of the receptacle body 6 as shown in FIG. 4. Specifically, two functional portion accommodating spaces 50 are formed in the receptacle body 6. Each functional portion accommodating space 50 is formed between the pair of side plates 17 in the pitch orthogonal direction. Each functional portion accommodating space 50 is formed between the corresponding top plate 19 and the plurality of cantilevers 16 in the pitch direction. To mount the assist fitting 8 on the receptacle body 6, each functional portion 31 is accommodated in the corresponding functional portion accommodating space 50. At this time, the claw portion 19*a* of each top plate 19 of the frame body 15 of the receptacle body 6 shown in FIG. 5 is accommodated in the claw accommodating hole 38 of the temporary holding portion 33 of the corresponding functional portion 31 of the assist fitting 8 shown in FIG. 11. As a result, each top plate 19 of the frame body 15 of the receptacle body 6 is sandwiched between the hook surface 39 of the leg portion 36 and the shoulder portion 37 of the temporary holding portion 33 of the corresponding functional portion 31 of the assist fitting 8 shown in FIG. 11. This structure regulates a relative displacement in the substrate orthogonal direction between the assist fitting 8 and the receptacle body 6. The regulation of a relative displacement in the substrate orthogonal direction between the assist fitting 8 and the receptacle body 6 allows the assist fitting 8 to be mounted on the receptacle body 6. Note that each top plate 19 of the frame body 15 of the receptacle body 6 is allowed to be slightly displaced in the substrate orthogonal direction between the hook surface 39 of the leg portion 36 and the shoulder portion 37 of the temporary holding portion 33 of the corresponding functional portion 31 of the assist fitting 8 shown in FIG. 11. In this sense, the temporary holding portion 33 temporarily holds the assist fitting 8 on the receptacle body 6, instead of fixing the assist fitting 8 to the receptacle body 6. At this time, the claw portion 19*a* of each top plate 19 of the frame body 15 of the receptacle body 6 shown in FIG. 5 is accommodated in the claw accommodating hole 38 of the temporary holding portion 33 of the corresponding functional portion 31 of the assist fitting 8 shown in FIG. 11, thereby regulating a relative displacement between the assist fitting 8 and the receptacle body 6 in the pitch direction and the pitch orthogonal direction.

Figure 10:
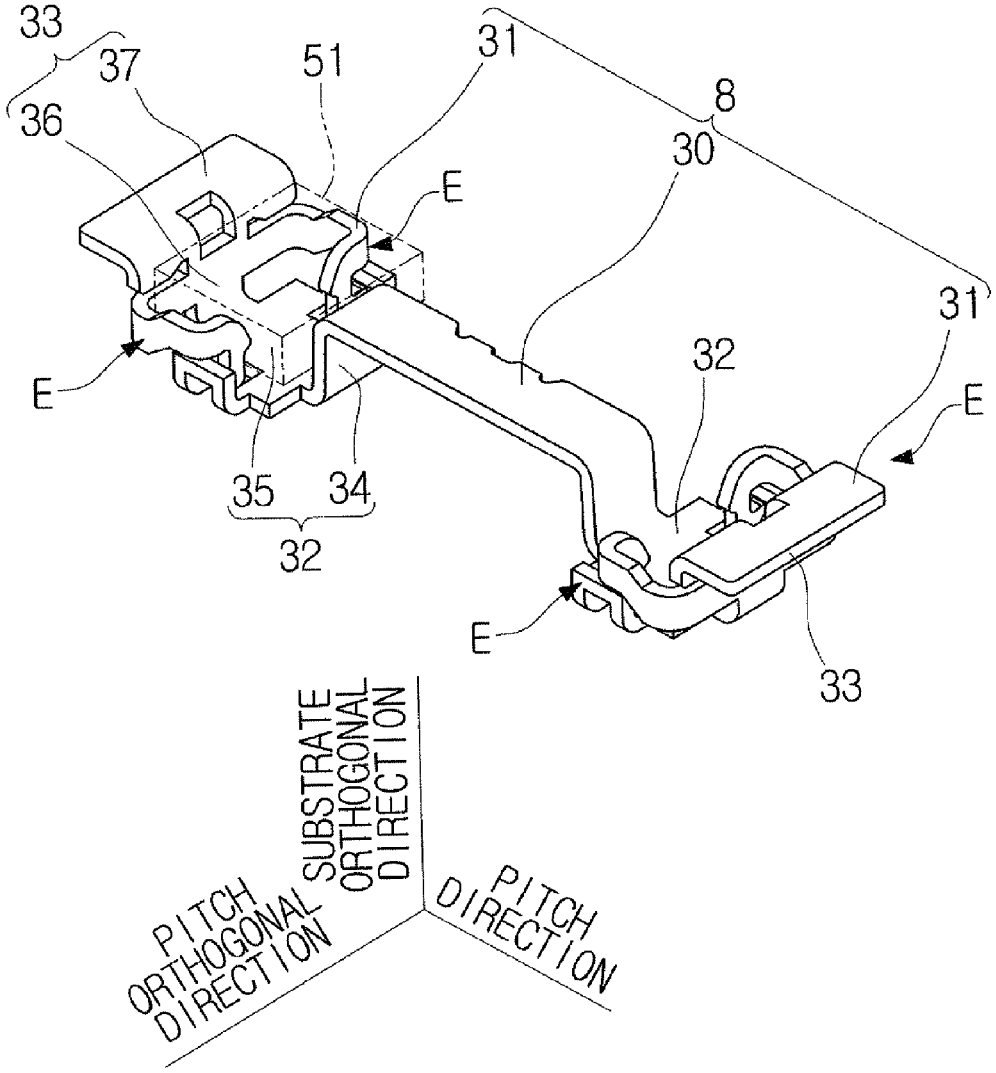
FIG. 10 is a perspective view of an assist fitting.

When the assist fitting 8 is mounted on the receptacle body 6 in the manner as described above, the contact cover 30 of the assist fitting 8 shown in FIG. 10 covers from above the substrate separating portion 16*b* of each cantilever 16 of the frame body 15 of the receptacle body 6 shown in FIG. 7 (also see FIGS. 1 and 2). In other words, the contact cover 30 is disposed on an opposite side of the connector mounting surface 2*a* of the receptacle-side substrate 2 with the substrate separating portions 16*b* of the plurality of cantilevers 16 interposed therebetween, thereby covering from above the substrate separating portions 16*b* of the plurality of cantilevers 16. The presence of the contact cover 30 prevents the substrate separating portions 16*b* of the plurality of cantilevers 16 from being crushed in the substrate approaching direction by the plug 5, during mating of the plug 5 with the receptacle 3.

Figure 12:
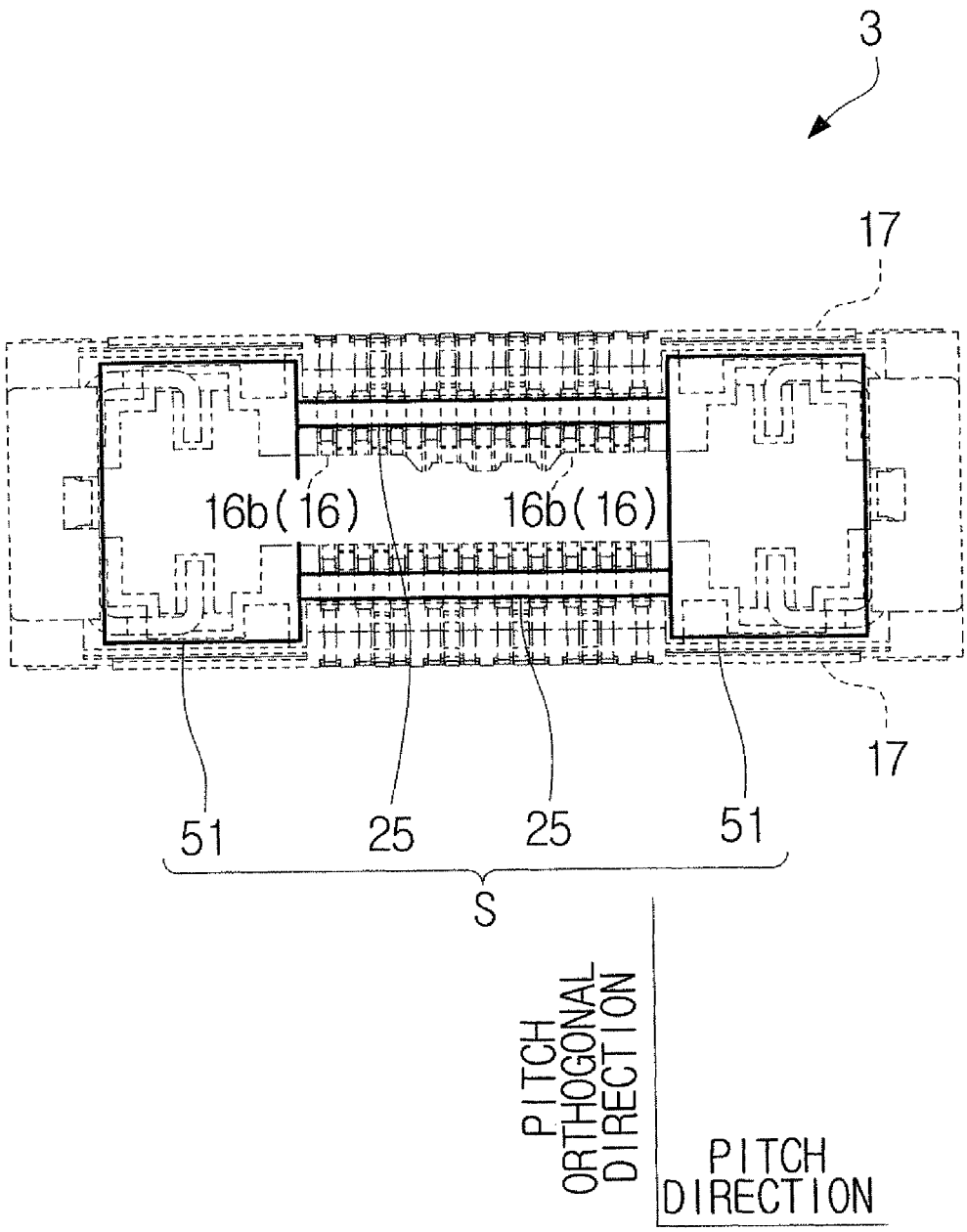
FIG. 12 is a plan view of the receptacle.

For ease of explanation, the receptacle 3 is illustrated by dashed lines in FIG. 12. When the assist fitting 8 is mounted on the receptacle body 6, a plug accommodating space S for accommodating the plug 5 is formed in the receptacle 3 as shown in FIG. 12. The plug accommodating space S is formed in an annular shape so as to surround the substrate separating portions 16*b* of the plurality of cantilevers 16 in the plan view of FIG. 12. The plug accommodating space S is formed in a loop shape so as to surround the substrate separating portions 16*b* of the plurality of cantilevers 16. The plug accommodating space S is formed of a pair of first plug accommodating spaces 25 and a pair of second plug accommodating spaces 51. The pair of first plug accommodating spaces 25 is formed so as to sandwich the substrate separating portions 16*b* of the plurality of cantilevers 16 in the pitch orthogonal direction. The pair of second plug accommodating spaces 51 is formed so as to sandwich the substrate separating portions 16*b* of the plurality of cantilevers 16 in the pitch direction. As shown in FIG. 10, each second plug accommodating space 51 is partitioned by the leg portion 34 of the contact cover fixing portion 32, the fixed portion 35 of the contact cover fixing portion 32, the leg portion 36 of the temporary holding portion 33, and the pair of side plates 17 shown in FIG. 12.

(Plug 5)

Figure 13:
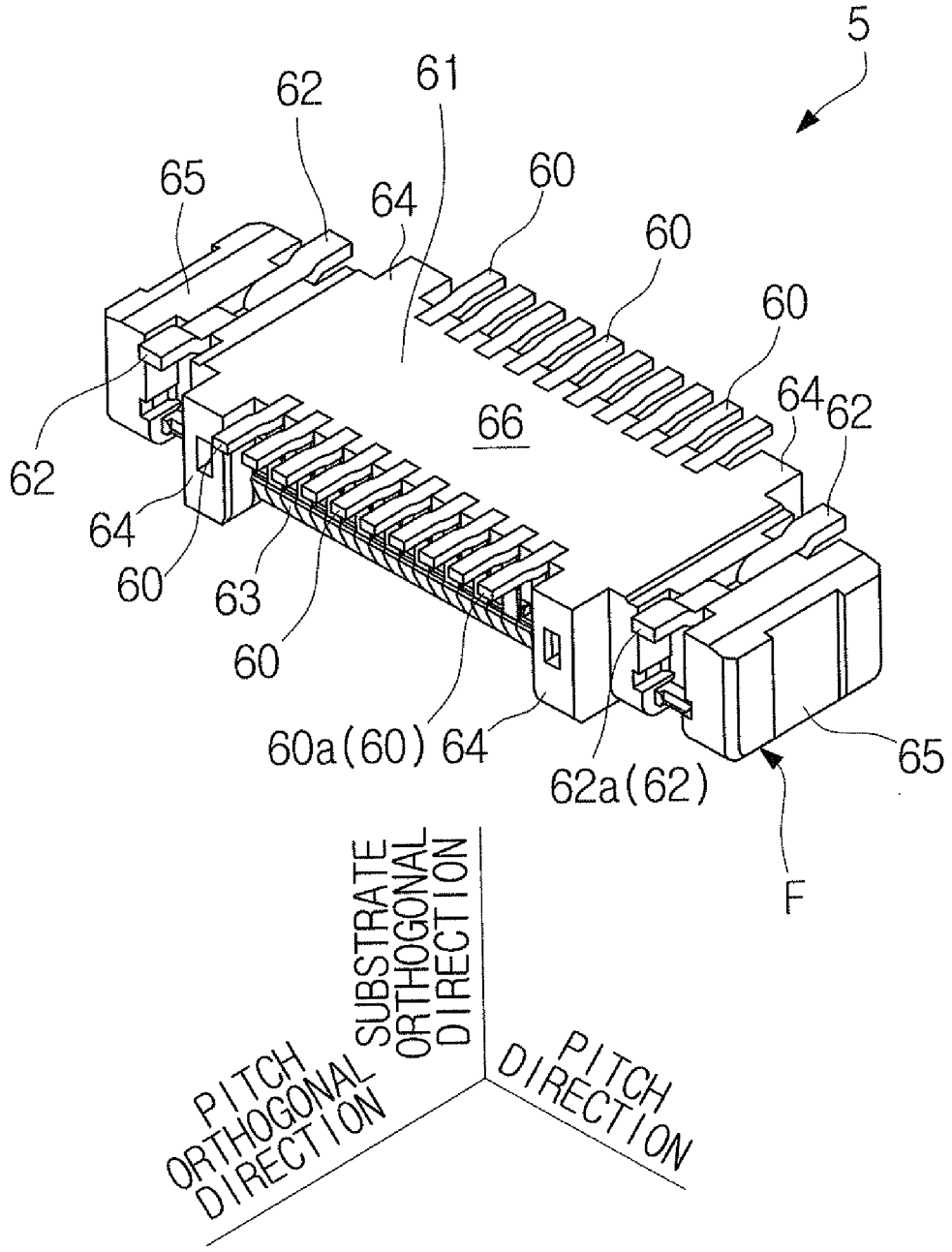
FIG. 13 is a perspective view of a plug.
Figure 14:
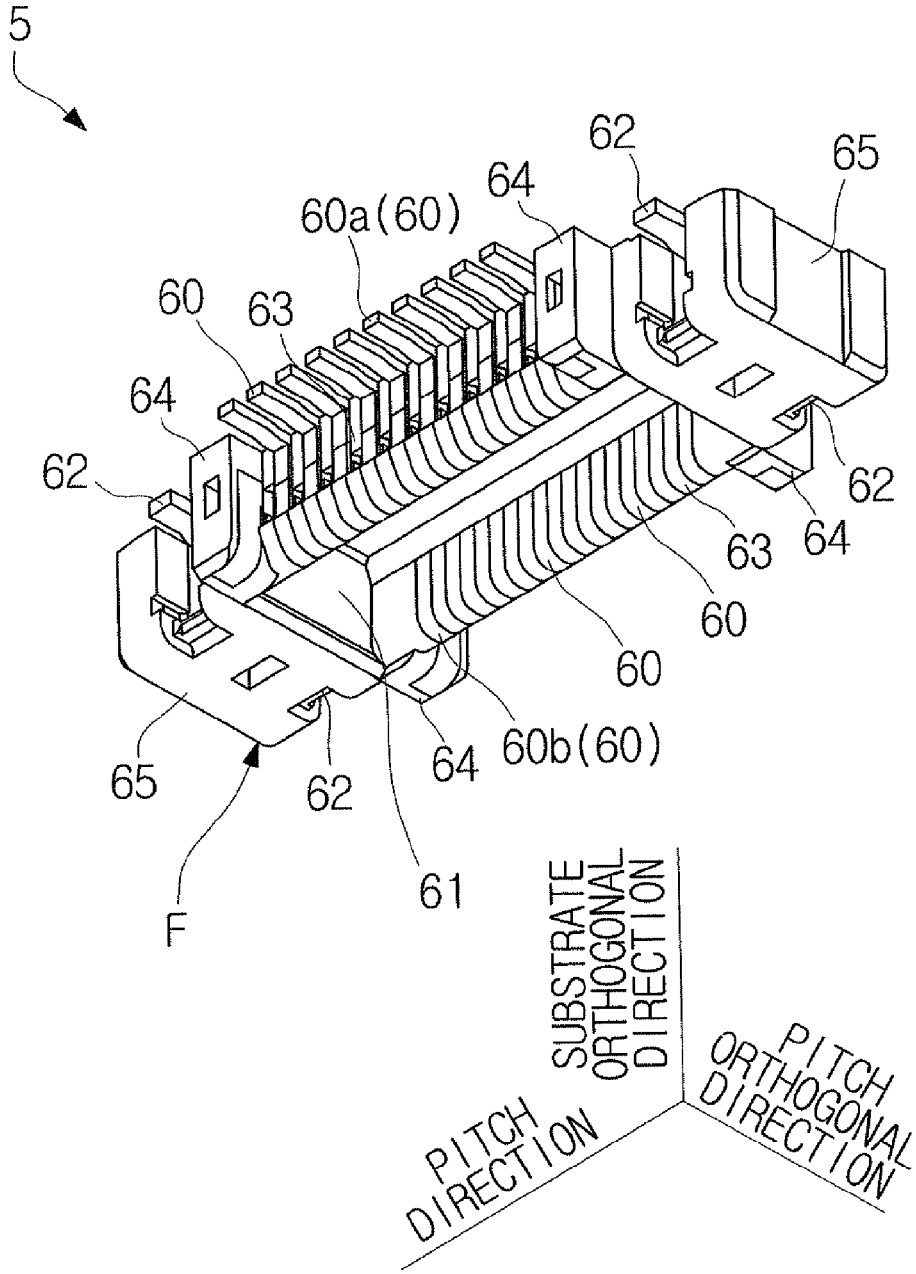
FIG. 14 is a perspective view of the plug viewed from another angle.

As shown in FIGS. 13 and 14, the plug 5 includes a plurality of plug contacts 60 (contacts), an insulator 61 that holds the plurality of plug contacts 60, and four assist fittings 62.

Figure 15:
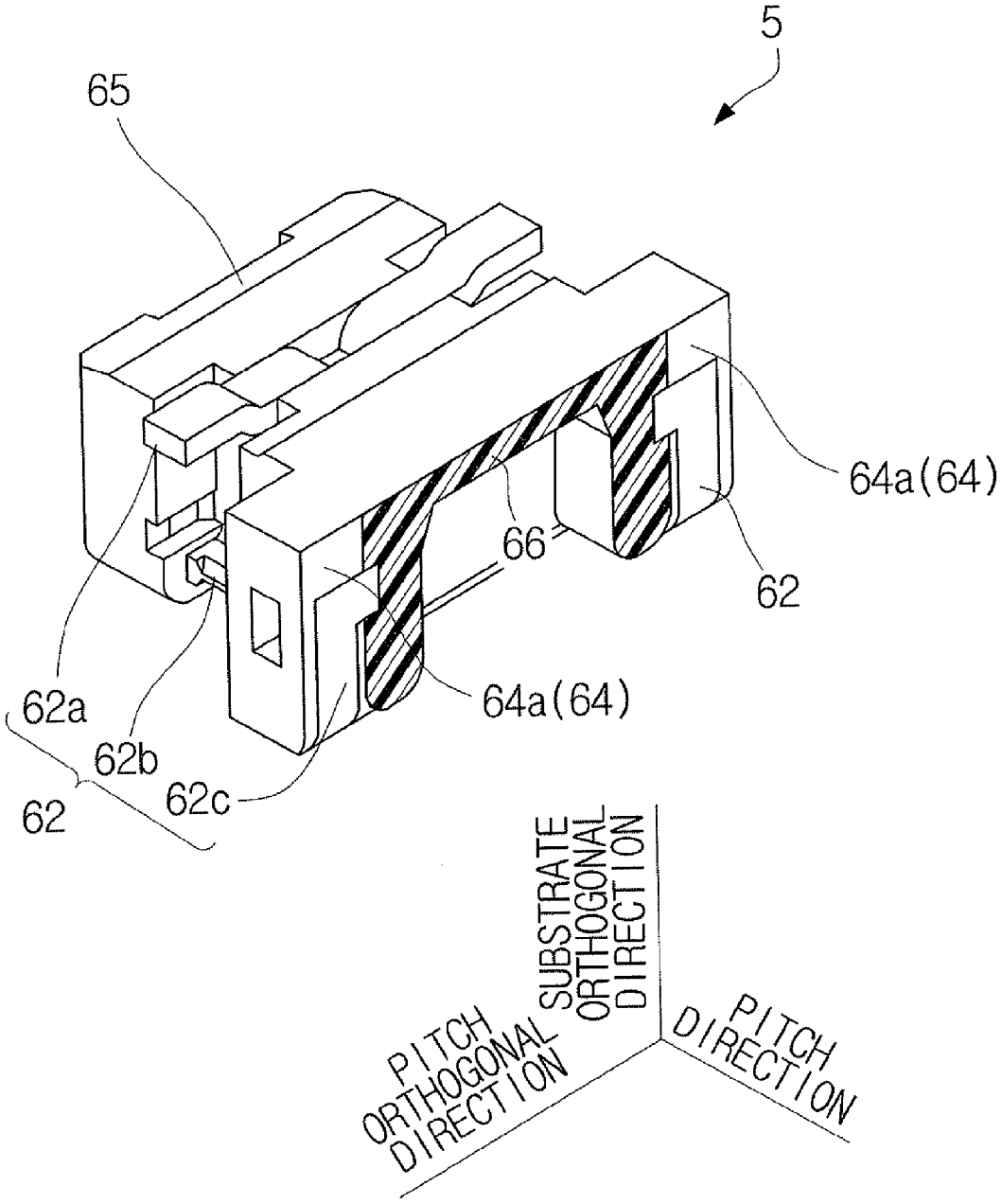
FIG. 15 is a partially cutaway perspective view of the plug.

The insulator 61 includes a pair of contact holding beams 63, four positioning convex portions 64, a pair of assist fitting holding portions 65, and a substrate opposing portion 66. The pair of contact holding beams 63 is a portion that holds the plurality of plug contacts 60. The pair of contact holding beams 63 is disposed at locations spaced apart from each other in the pitch orthogonal direction. The pair of contact holding beams 63 is formed in an elongated shape along the pitch direction. Two positioning convex portions 64 are disposed at both of the ends in the pitch direction of one of the contact holding beams 63. The other two positioning convex portions 64 are disposed at both of the ends in the pitch direction of the other contact holding beam 63. Each positioning convex portion 64 projects in the pitch orthogonal anti-center direction as compared with the contact holding beams 63. As shown in FIG. 15, each positioning convex portion 64 has a reference surface 64*a* that faces in the pitch center direction. As shown in FIGS. 13 and 14, the pair of assist fitting holding portions 65 is a portion that holds the four assist fittings 62. One of the assist fitting holding portions 65 holds two assist fittings 62. The other assist fitting holding portion 65 holds the other two assist fittings 62. The pair of assist fitting holding portions 65 is disposed to sandwich the pair of contact holding beams 63 in the pitch direction. In the structure described above, the pair of contact holding beams 63, the four positioning convex portions 64, and the pair of assist fitting holding portions 65 constitute an accommodated portion F which is accommodated in the plug accommodating space S of the receptacle 3. As shown in FIG. 14, the accommodated portion F forms a loop when viewed along the substrate separating direction. The accommodated portion F is formed in a loop shape when viewed along the substrate separating direction. The accommodated portion F is formed in an annular shape when viewed along the substrate separating direction. The substrate opposing portion 66 shown in FIG. 13 is a portion that is opposed to the connector mounting surface 4*a* of the plug-side substrate 4. The thickness direction of the substrate opposing portion 66 coincides with the substrate orthogonal direction. The substrate opposing portion 66 blocks an end in the substrate separating direction of the accommodated portion F.

As shown in FIGS. 13 and 14, each plug contact 60 is held by insert molding on the pair of contact holding beams 63. As shown in FIG. 14, each plug contact 60 includes a soldered portion 60*a* which is soldered onto the connector mounting surface 4*a* of the plug-side substrate 4, and a contact portion 60*b* which is formed in a U-shape.

Figure 16:
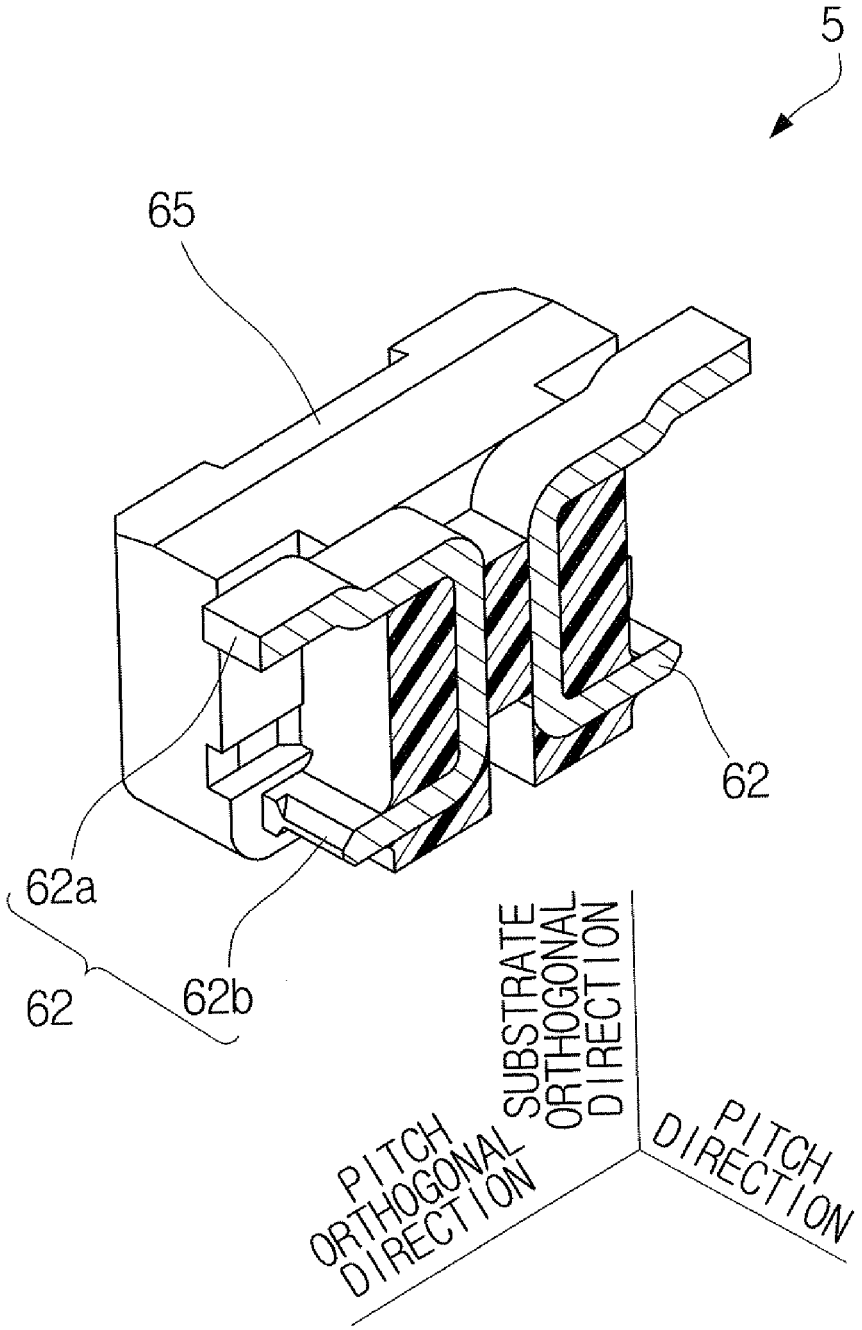
FIG. 16 is another partially cutaway perspective view of the plug.

As shown in FIG. 15, each assist fitting 62 is held by insert molding on the positioning convex portions 64 and the assist fitting holding portions 65. Each assist fitting 62 includes a soldered portion 62*a*, a locking claw 62*b*, and a positioning guide portion 62*c*. As shown in FIGS. 15 and 16, the soldered portion 62*a* is a portion which is soldered onto the connector mounting surface 4*a* of the plug-side substrate 4. The locking claw 62*b* is formed so as to project from each assist fitting holding portion 65 in the pitch orthogonal anti-center direction. The positioning guide portion 62*c* is exposed to the reference surface 64*a* of each positioning convex portion 64.

(Usage of Connector Unit 1)

Next, the usage of the connector unit 1 will be described. As shown in FIG. 1, the connector unit 1 is a connector for electrically connecting the receptacle-side substrate 2 to the plug-side substrate 4.

First, the receptacle 3 is mounted on the connector mounting surface 2*a* of the receptacle-side substrate 2. Specifically, the plurality of conductive patterns 11 and the plurality of hold-down patterns 12, which are shown in FIG. 6, are soldered onto the connector mounting surface 2*a* of the receptacle-side substrate 2 shown in FIG. 1. After that, the fixed portion 35 of the contact cover fixing portion 32 of the assist fitting 8 shown in FIG. 10 is soldered onto the connector mounting surface 2*a* of the receptacle-side substrate 2.

Next, the plug 5 is mounted on the connector mounting surface 4*a* of the plug-side substrate 4. Specifically, the soldered portion 60*a* of each plug contact 60 and the soldered portion 62*a* of each assist fitting 62, which are shown in FIG. 13, are soldered onto the connector mounting surface 4*a* of the plug-side substrate 4 shown in FIG. 1.

Figure 17:
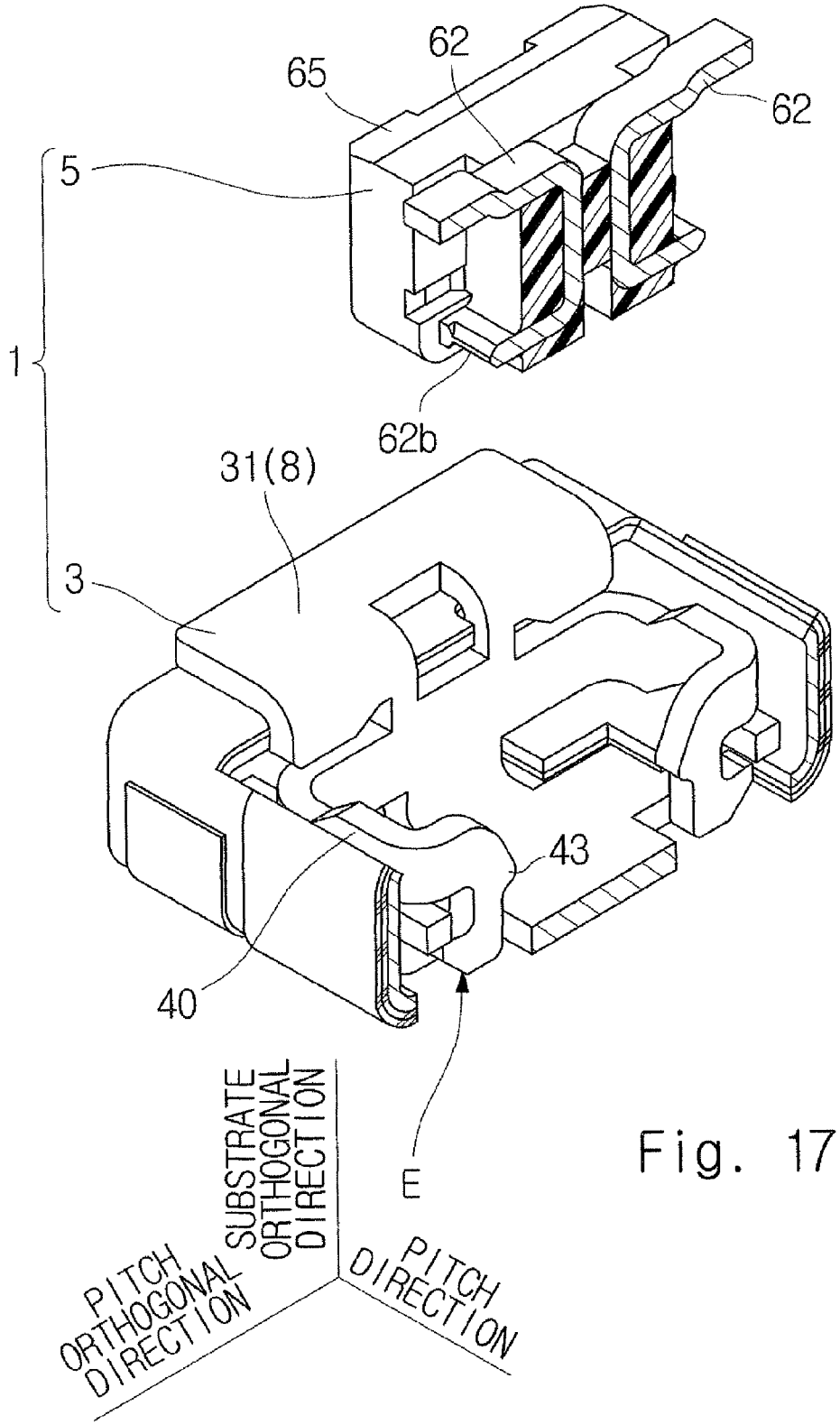
FIG. 17 is an explanatory view showing mating of the receptacle and the plug.
Figure 18:
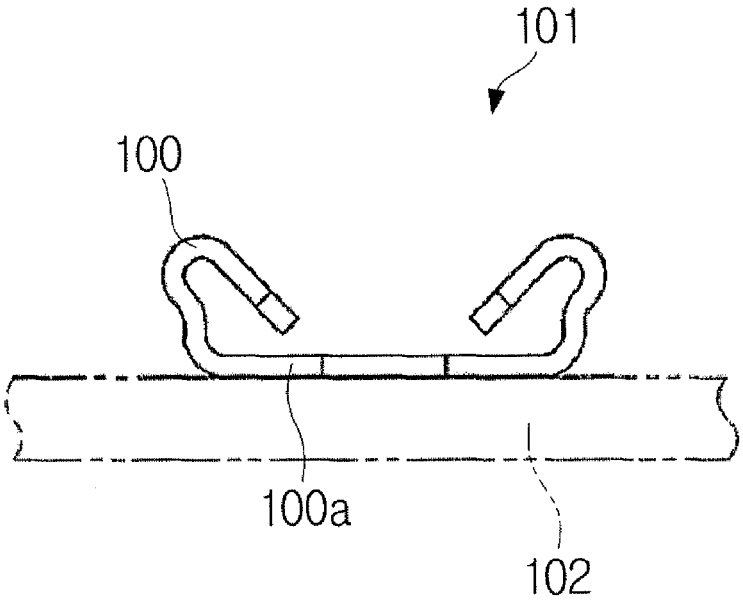
FIG. 18 is a diagram corresponding to FIG. 8 of Japanese Unexamined Patent Application Publication No. 2006-228612.
Figure 19:
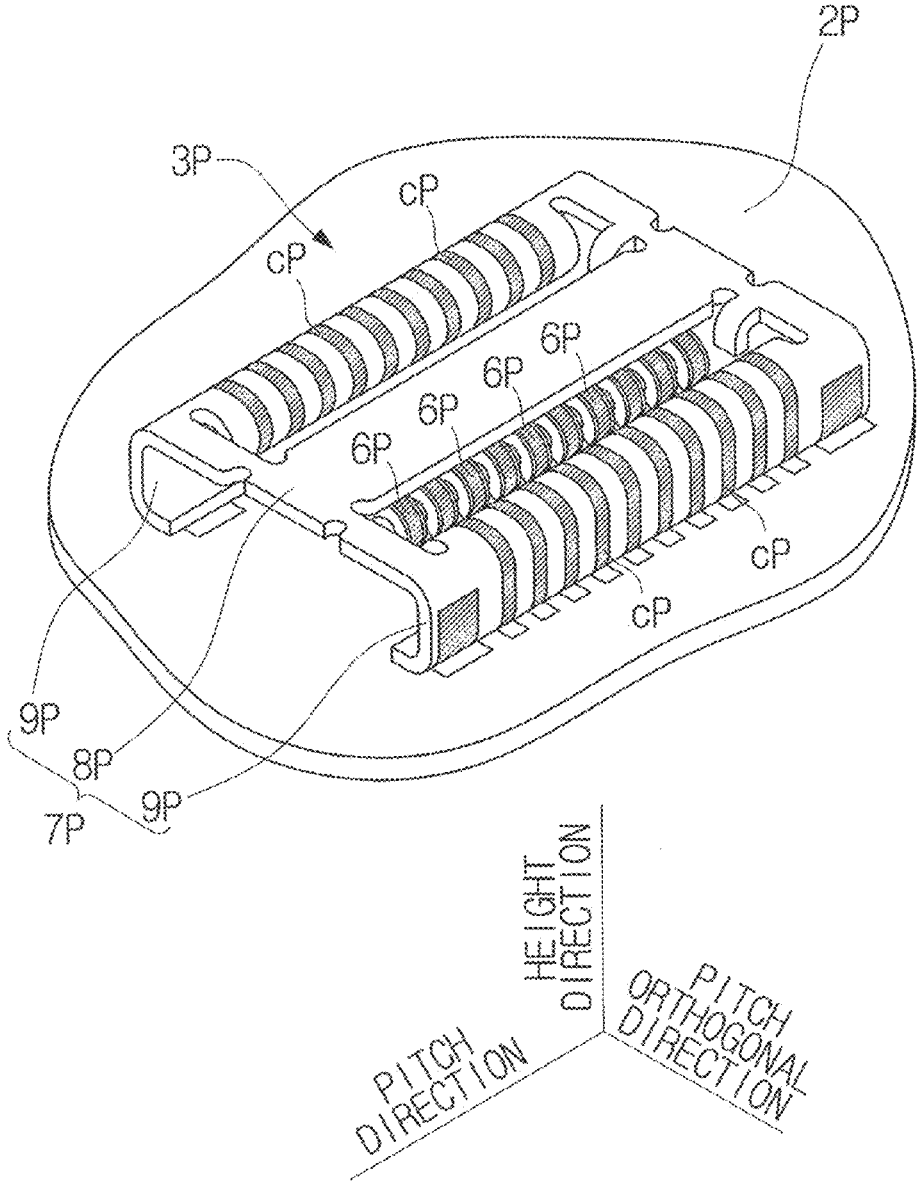
FIG. 19 is a perspective view of a receptacle connector of related art.
Figure 20:
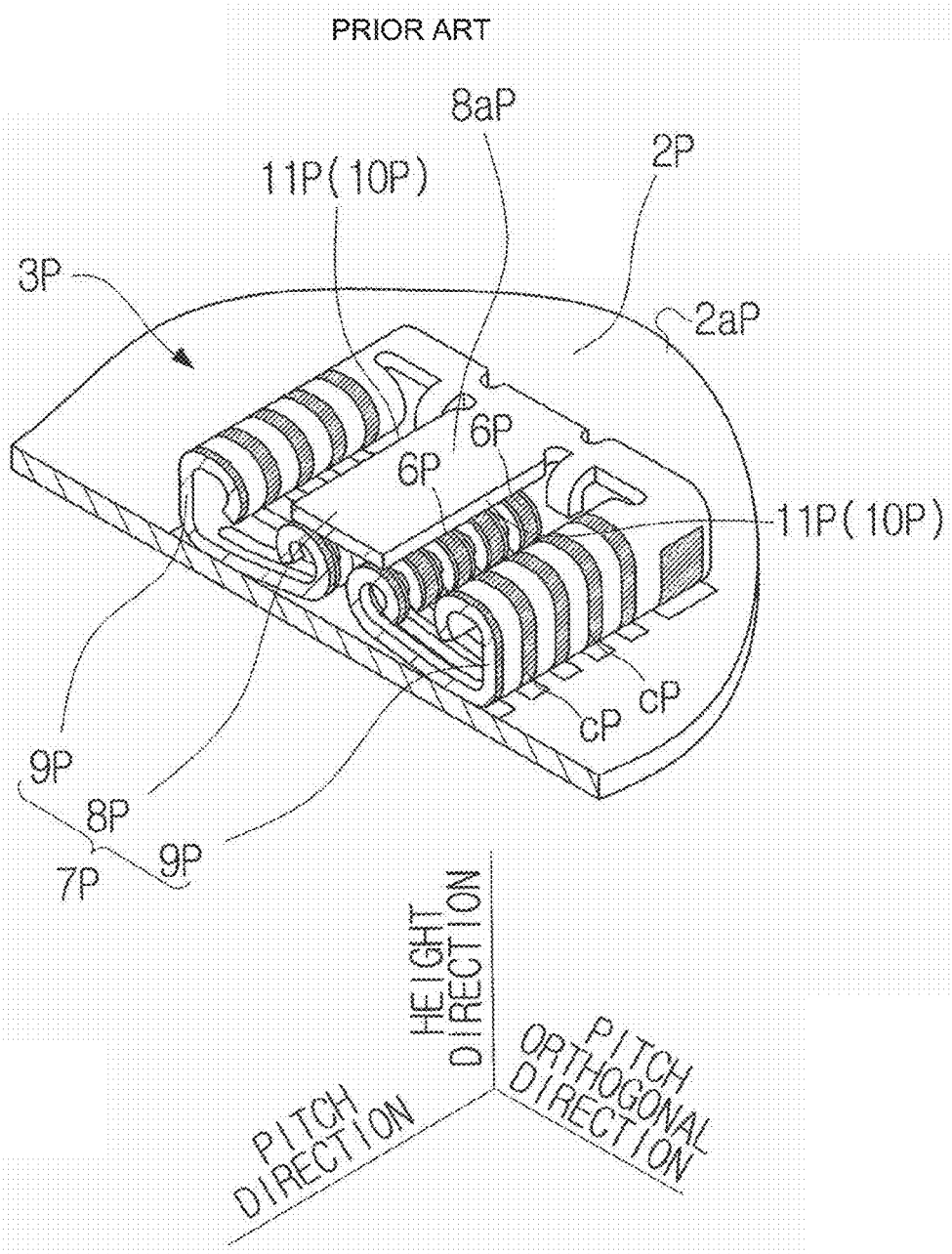
FIG. 20 is a partially cutaway perspective view of the receptacle connector of the related art.
Figure 21:
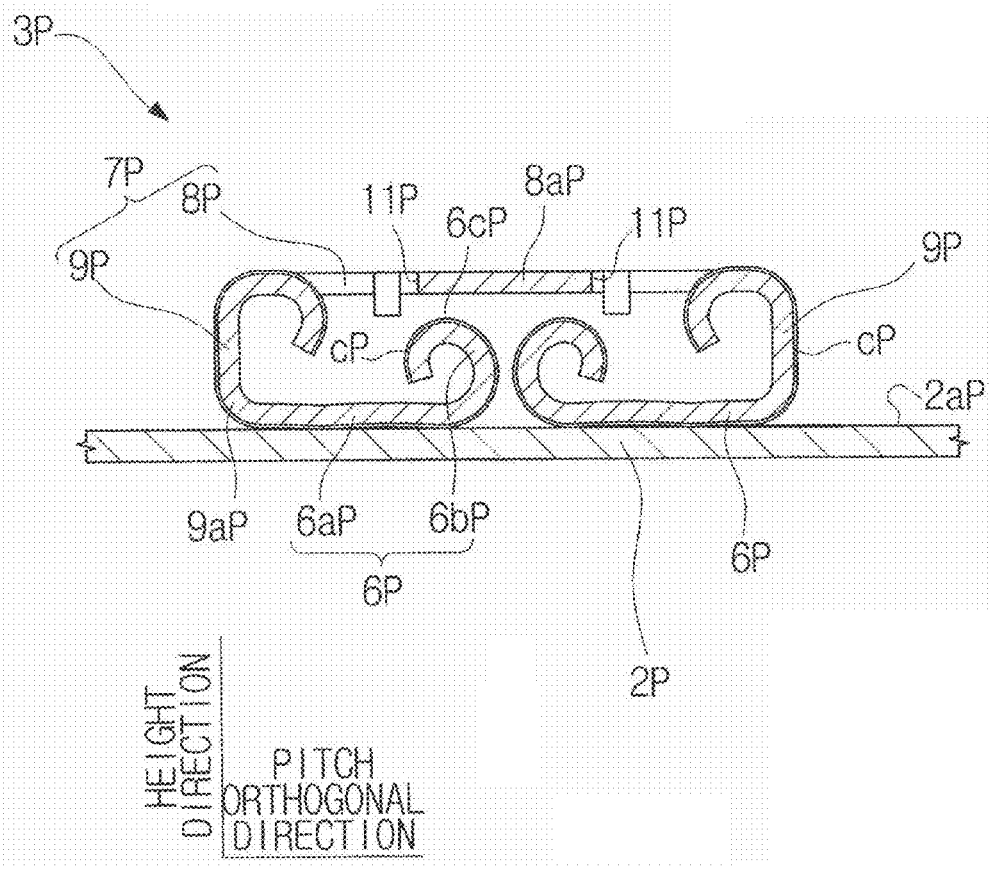
FIG. 21 is a front sectional view of the receptacle connector of the related art.

Then, the connector mounting surface 2*a* of the receptacle-side substrate 2 and the connector mounting surface 4*a* of the plug-side substrate 4 are opposed to each other, to thereby allow the plug 5 to mate with the receptacle 3. Specifically, the accommodated portion F of the plug 5 shown in FIG. 14 is inserted into the plug accommodating space S of the receptacle 3 shown in FIG. 12. That is, the pair of contact holding beams 63 of the plug 5 shown in FIG. 14 is inserted into the pair of first plug accommodating spaces 25 shown in FIG. 12. This allows the plug contacts 60 of the plug 5 to be brought into contact with the respective conductive patterns 11 of the receptacle 3. At the same time, the pair of assist fitting holding portions 65 and the four positioning convex portions 64 of the plug 5 shown in FIG. 14 are inserted into the pair of second plug accommodating spaces 51 of the receptacle 3 shown in FIG. 12. This allows the locking claw 62*b* of each assist fitting 62 of the plug 5 shown in FIG. 17 to hook on to the locking claw 43 of the locking piece 40 of the locking mechanisms E of the corresponding functional portion 31 of the assist fitting 8 of the receptacle 3. This results in preventing disengagement of the plug 5 from the receptacle 3. The positioning guide portion 62*c* of each assist fitting 62 of the plug 5 shown in FIG. 15 is brought into contact with the end face 20*a* of each guide plate 20 of the frame body 15 of the receptacle body 6 shown in FIG. 5. This contact enables positioning of the receptacle 3 and the plug 5 in the pitch direction. Specifically, positioning of the plurality of conductive patterns 11 of the receptacle 3 and the plurality of plug contacts 60 of the plug 5 in the pitch direction is achieved.

While exemplary embodiments of the present invention have been described above, the above exemplary embodiments have the following features.

(1) The receptacle 3 (connector) used to be mounted on the receptacle-side substrate 2 (substrate) includes: the frame body 15 (metal frame body); the plurality of cantilevers 16 (metal cantilevers) formed to extend from the frame body 15 and including the substrate separating portion 16*b* extending in a direction away from the receptacle-side substrate 2; the contact cover 30 (cover body) disposed on an opposite side of the receptacle-side substrate 2 with the substrate separating portions 16*b* of the plurality of cantilevers 16 interposed therebetween, and covering the substrate separating portions 16*b* of the plurality of cantilevers 16; and the plurality of conductive patterns 11 formed above the plurality of cantilevers 16 with the insulating layer 10 interposed therebetween. The frame body 15 forms the plug accommodating space S (counterpart connector accommodating space) for accommodating the plug 5 (counterpart connector). The plug accommodating space S is formed so as to surround the substrate separating portions 16*b* of the plurality of cantilevers 16. According to the structure described above, the accommodated portion F, which is accommodated in the plug accommodating space S of the receptacle 3, can be formed so as to surround the substrate separating portions 16*b* of the plurality of cantilevers 16. This facilitates securing of the strength of the plug 5.

(2) The receptacle 3 further includes the contact cover fixing portion 32 (cover body fixing portion) for fixing the contact cover 30 to the receptacle-side substrate 2. According to the structure described above, the fixation of the contact cover 30 is reinforced in the state where the receptacle 3 is mounted on the receptacle-side substrate 2.

(3) The contact cover fixing portion 32 includes the leg portion 34 extending from the contact cover 30 toward the receptacle-side substrate 2, and the fixed portion 35 to be fixed to the receptacle-side substrate 2.

(4) The receptacle 3 further includes the temporary holding portion 33 for temporarily holding the contact cover 30 on the frame body 15. According to the structure described above, the contact cover 30 can be temporarily held on the frame body 15 prior to the fixation of the contact cover 30 to the receptacle-side substrate 2. This facilitates assembling.

(5) The contact cover fixing portion 32 is disposed between the contact cover 30 and the temporary holding portion 33.

(6) The connector unit 1 includes the receptacle 3 and the plug 5. The plug 5 includes the plurality of plug contacts 60 and the insulator 61 that holds the plurality of plug contacts 60. The insulator 61 includes the accommodated portion F to be accommodated in the plug accommodating space S of the receptacle 3. According to the structure described above, the accommodated portion F, which is accommodated in the plug accommodating space S of the receptacle 5, can be formed so as to surround the substrate separating portions 16*b* of the plurality of cantilevers 16. This facilitates securing of the strength of the plug 5.

(7) The plug 5 includes the positioning guide portion 62*c* (positioning contact portion) to be brought into contact with the receptacle 3 in the pitch direction to perform positioning of the plurality of conductive patterns 11 of the receptacle 3 and the plurality of plug contacts 60 of the plug 5 in the pitch direction.

(8) The positioning guide portion 62*c* is made of metal. According to the structure described above, it is possible to prevent degradation of the positioning accuracy due to damage, chipping, or the like of the insulator 61 of the plug 5 during mating of the plug 5 with the receptacle 3.

(9) The receptacle 3 further includes the locking mechanisms E that hook on to the plug 5 to prevent the plug 5 mating with the receptacle 3 from being disengaged from the receptacle 3. According to the structure described above, the plug 5 mating with the receptacle 3 is prevented from being disengaged from the receptacle 3.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A connector unit, comprising:

a connector used to be mounted on a substrate, and a counterpart connector, wherein the connector includes a metal frame body made of metal;

a plurality of metal cantilevers integrally formed with the metal frame body and formed to extend from the metal frame body and including a horizontal portion inclined in a direction away from the substrate and a substrate separating portion extending from the horizontal portion in the direction away from the substrate, wherein the horizontal portions that are adjacent to each other are connected with a beam connecting portion;

a cover body disposed on an opposite side of the substrate with the substrate separating portion of the plurality of metal cantilevers interposed therebetween, and covering the substrate separating portion of the plurality of metal cantilevers; and a plurality of conductive patterns formed above the plurality of metal cantilevers with an insulating layer interposed therebetween, wherein the metal frame body forms a counterpart connector accommodating space for accommodating a counterpart connector, wherein the counterpart connector accommodating space is formed so as to surround the substrate separating portion of the plurality of metal cantilevers, wherein the cover body is separately configured from the metal frame body, and wherein the counterpart connector includes a plurality of contracts and an insulator that holds the plurality of contacts, and wherein the insulator includes an accommodated portion to be accommodated in the counterpart connector accommodating space of the connector.

2. The connector unit according to claim 1, the connector further comprising a cover body fixing portion for fixing the cover body to the substrate.

3. The connector unit according to claim 2, wherein the cover body fixing portion includes a leg portion extending from the cover body toward the substrate, and a fixed portion to be fixed to the substrate.

4. The connector unit according to claim 2, the connector further comprising a temporary holding portion for temporarily holding the cover body on the metal frame body.

5. The connector unit according to claim 4, wherein the cover body fixing portion is disposed between the cover body and the temporary holding portion.

6. The connector unit according to claim 1, wherein the counterpart connector includes a positioning contact portion to be brought into contact with the connector in a pitch direction to perform positioning of the plurality of conductive patterns of the connector and the plurality of contacts of the counterpart connector in the pitch direction.

7. The connector unit according to claim 6, wherein the positioning contact portion is made of metal.

8. The connector unit according to claim 1, wherein the connector further comprises a locking mechanism that hooks on to the counterpart connector to prevent the counterpart connector mating with the connector from being disengaged from the connector.

* * * * *